US009123318B2

(12) United States Patent
Kamiya

(10) Patent No.: US 9,123,318 B2
(45) Date of Patent: Sep. 1, 2015

(54) OBJECT BASED MUSICAL COMPOSITION PERFORMANCE APPARATUS AND PROGRAM

(75) Inventor: Taishi Kamiya, Tokyo-to (JP)

(73) Assignee: Yamaha Corporation, Hamamatsu-Shi, Shizuoka-Ken (JP)

( * ) Notice: Subject to any disclaimer, the term of this patent is extended or adjusted under 35 U.S.C. 154(b) by 361 days.

(21) Appl. No.: 12/755,265

(22) Filed: Apr. 6, 2010

(65) Prior Publication Data

US 2010/0257995 A1 Oct. 14, 2010

(30) Foreign Application Priority Data

Apr. 8, 2009 (JP) ..... 2009-093978
Apr. 8, 2009 (JP) ..... 2009-093979
Mar. 12, 2010 (JP) ..... 2010-056129

(51) Int. Cl.
*G10H 7/00* (2006.01)
*G10H 1/00* (2006.01)

(52) U.S. Cl.
CPC ..... *G10H 1/0025* (2013.01); *G10H 2210/105* (2013.01); *G10H 2210/125* (2013.01); *G10H 2220/005* (2013.01); *G10H 2240/135* (2013.01)

(58) Field of Classification Search
USPC ..... 84/609
See application file for complete search history.

(56) References Cited

U.S. PATENT DOCUMENTS 5,085,116 A * 2/1992 Nakata et al. ..... 84/609
6,528,715 B1 * 3/2003 Gargi ..... 84/615
7,179,982 B2 * 2/2007 Goto ..... 84/616
7,390,958 B2 * 6/2008 Knudsen ..... 84/645
2008/0148924 A1 * 6/2008 Tsui et al. ..... 84/618

FOREIGN PATENT DOCUMENTS

JP 07-121163 5/1995
JP 2008-225200 9/2008

OTHER PUBLICATIONS

Doerffel, T. (Dec. 2005). "Making Music with Linux Multimedia Studio Music Builder," Linux Magazine, Issue 61, located at <http://www.linux-magazine.com/w3/issue61/Making_Music_with_Linux_Multimedia_Studio.pdf>, last visited May 11, 2010, three pages.

(Continued)

*Primary Examiner* — Christopher Uhlir
(74) *Attorney, Agent, or Firm* — Morrison & Foerster LLP

(57) ABSTRACT

In a musical performance apparatus, a time line management processing part displays one or more of time lines on a display unit according to an operation of an operating unit, each time line being an image representing a period for a sequence of one or more of sounds that repeat in a piece of music. An object management processing part displays one or more of objects on the display unit according to an operation of the operating unit, each object being a symbol corresponding to and representing a sound to be generated. A musical performance processing part determines belongingness of each object to the one or more of the time lines displayed on the display unit, and repeats control of generating sounds corresponding to the objects in parallel and independently for each time line at the period corresponding to each time line, such that each sound is generated at a sound generation timing determined according to a position of the corresponding object in a longitudinal direction of the time line to which the corresponding object belongs.

9 Claims, 14 Drawing Sheets

(56) References Cited

OTHER PUBLICATIONS

European Search Report mailed Jun. 25, 2010, for EP Application No. 10158620.4, 10 pages.

JohnnyVTC. (Oct. 20, 2000). VTC Sony Acid Pro 6—Adding More Loops, YouTube, located at <http://www.youtube.com/watch?v=J0f4qXHrFqE>, last visited May 18, 2010, one page.

Mobilephone2003. (Aug. 9, 2009). "How to Create a Song/Tune for Free With LMMS," YouTube, located at <http://www.youtube.com/watch?v=AzT4X8vweaE&feature=related>, last visited May 18, 2010, one page.

Patrick1293. (Sep. 23, 2008). "How to Make Popcord in LMMS," YouTube, located at <http:/www.youtube.com/watch?v=pfQYJiLLH0k>, last visited May 11, 2010, one page.

Walden, J. (Jul. 2006). "Sony Acid Pro 6: Audio & MIDI Loop Sequences [Windows]," Sound on Sound, located at <http://www.soundonsound.com/sos/jul06/articles/sonyacid6.htm?print=yes>, last visited May 18, 2010, four pages.

Japanese Notice of Reason for Rejection mailed Jul. 30, 2013 for Japanese Patent Application No. 2009-093978, six pages.

* cited by examiner

FIG.2

| MUSIC NUMBER k | TIME $t_S$ | TIME $t_E$ | FEATURE QUANTITY $P_{LOW}$ | FEATURE QUANTITY $P_{MID-LOW}$ | FEATURE QUANTITY $P_{MID-HIGH}$ | FEATURE QUANTITY $P_{HIGH}$ | FEATURE QUANTITY $P_{TIME}$ | FEATURE QUANTITY $P_{VALUE}$ |
|---|---|---|---|---|---|---|---|---|
| ... | ... | ... | ... | ... | ... | ... | ... | ... |
| ... | ... | ... | ... | ... | ... | ... | | |
| ... | | | | | | | | |

OBJECT BASED MUSICAL COMPOSITION PERFORMANCE APPARATUS AND PROGRAM

BACKGROUND OF THE INVENTION

1. Technical Field of the Invention

The present invention relates to a technology for assisting in composing work of music. The present invention also relates to a technology for assisting in searching sound materials used for composing music.

2. Description of the Related Art

A variety of music creation application programs, which are called a "loop sequencer", have been provided along with the spread of so-called Desk Top Music (DTM). The loop sequencer is a program that generates a phrase by mapping sound samples, which are sound waveforms of partial time sections of a piece of music such as one measure corresponding to the intro of the piece of music and four measures corresponding to drum solo, onto the time axis and that repeats reproduction of the generated phrase. The loop sequencer provides an editing screen which allows the user to specify an arrangement of sounds in one period of a phrase included in a piece of music. When the user has specified an arrangement of sounds through this editing screen, a piece of music which repeats the arrangement of sounds as one period of a phrase is performed through the loop sequencer. An example reference regarding this type of loop sequencer is Japanese Patent Application Publication No. 2008-225200.

In some case, a piece of music including a plurality of phrases that are played simultaneously is composed and performed. In this case, it takes a lot of trial and error to perform adjustment of the timing relationship of phrases or the like. The conventional loop sequencer causes trouble since it is necessary to change the timings of generation of sounds of each phrase one by one each time such trial and error is done.

There is known another music performance apparatus having a database collecting sound materials which are segments of sound waveforms. The music performance apparatus connects sound materials searched from the database to create a phrase for performing a piece of music. The database of such a type of the music performance apparatus stores a plurality of types of sound materials and a plurality of types of feature quantities which are obtained for each of the sound materials. Each sound material and its feature quantities are stored in the database in correspondence to each other. When a user specifies, as a searcher, feature quantities of a sound material imaged by the user through a search screen, a sound material having feature quantities close to the specified feature quantities is searched from the database and provided as components of the phrase. An example reference regarding this type of the apparatus is Japanese Patent Application Publication No. H07-121163.

However, the searching screen of the conventional music performance apparatus is often provided with condition input columns for specifying feature quantities as searching conditions independently for each of a plurality of types of features. Therefore, in case that the user searches for the sound materials using the plurality of types of features as the searching condition, there is a problem that the user cannot well grasp the searching condition of the sound material desired by the user even when the user vies the contents of the condition input columns.

SUMMARY OF THE INVENTION

In view of the above noted circumstances, the present invention aims to readily perform a piece of music composed of frames having different periods. The present invention also aims to facilitate searching of sound materials from a database which is a collection of a plurality of sound materials.

The invention provides a musical performance apparatus comprising: an operating part; a display part; a time line management processing part that displays one or more of time lines on the display part according to an operation of the operating part, each time line being an image representing a period for a sequence of one or more of sounds that repeat in a piece of music; an object management processing part that displays one or more of objects on the display part according to an operation of the operating part, each object being a symbol corresponding to and representing a sound to be generated; and a musical performance processing part that determines belongingness of each object to the one or more of the time lines displayed on the display part, and that repeats control of generating sounds corresponding to the objects in parallel and independently for each time line at the period corresponding to each time line, such that each sound is generated at a sound generation timing determined according to a position of the corresponding object in a longitudinal direction of the time line to which the corresponding object belongs.

Preferably, the musical performance processing part determines the belongingness of the object to the time line based on a positional relationship between the object and the time line in a display region of the display part.

Preferably, the musical performance processing part controls a parameter representing a sound generation mode of the sound represented by the corresponding object according to a distance from the corresponding object to the time line to which the corresponding object belongs.

Preferably, the time line management processing part displays the time lines on the display part such as to intersect with each other, the object management processing part displays an object at a grid point at which the time lines intersect with each other, and the musical performance processing part determines the belongingness of the object such that the object belongs to both of the time lines intersecting with each other at the grid point where the object is placed.

According to the invention, the time line graphically represents a period of a sequence of one or a plurality of sounds that is repeated in a piece of music, and an object graphically represents a sound that is generated in the period. The user, who is an operator of the musical performance apparatus, can easily create a piece of music including phrases that are played simultaneously by specifying a positional relationship between the objects and the time lines such that one or a plurality of objects are allocated to one or more of time lines.

In another aspect of the invention, the musical performance apparatus further comprises: a storage part that stores materials representing a plurality of sounds and feature quantity data in correspondence to the plurality of the sounds, the feature quantity data representing a plurality of features of the sound; and a searching control part that controls the object management processing part to display an object having a form indicating a search condition for searching a sound having desired features, wherein the searching control part changes the form of the object and the searching condition of the desired sound in association with each other according to an operation of the operating part, and searches the feature quantity data in the storage part based on the searching condition to locate at least one sound having features which meet the search condition.

Preferably, the searching control part controls the object management processing part to display the object having the form indicating, as the searching condition, features of desired sounds and a requested number of the desired sounds to be located, and the searching control part searches the feature quantity data in the storage part based on the searching condition to locate the requested number of sounds having features which meet the search condition.

Preferably, the searching control part controls the object management processing part to display a new object on a display region of the display part according to an operation of the operating part, the new object being copied from an original object displayed on the display region such that the new object has the same form as that of the original object, and the searching control part updates the searching condition indicated by the form of the new object and the searching condition indicated by the form of the original object synchronously with each other.

According to the invention, the searching control part changes the form of the object displayed in the display part in linked manner with the searching condition of the object. Therefore, the user who is also an operator, can readily recognize the searching condition which is specified by the user from the appearance or form of the displayed object, thereby realizing the searching condition of the sound material matching with an image of the user.

The music performance editing apparatus disclosed in the Japanese Patent Application Publication No. H07-121163 displays icons representing a plurality of patterns of sound materials having a predetermined time length on a song window which is an operating screen, and generates a sound signal of a piece of music which is obtained by connecting the patterns corresponding to the icons selected on the song window. However, this type of music performance data editing apparatus does not search sound material matching with the searching condition among the plurality of the sound materials, and is therefore different from the present invention.

BRIEF DESCRIPTION OF THE DRAWINGS

FIG. 2 is a data structure diagram of a sound sample database of the sound search/musical performance apparatus.

DETAILED DESCRIPTION OF THE INVENTION

Embodiments of the invention will now be described with reference to the drawings.

First Embodiment

Figure 1:
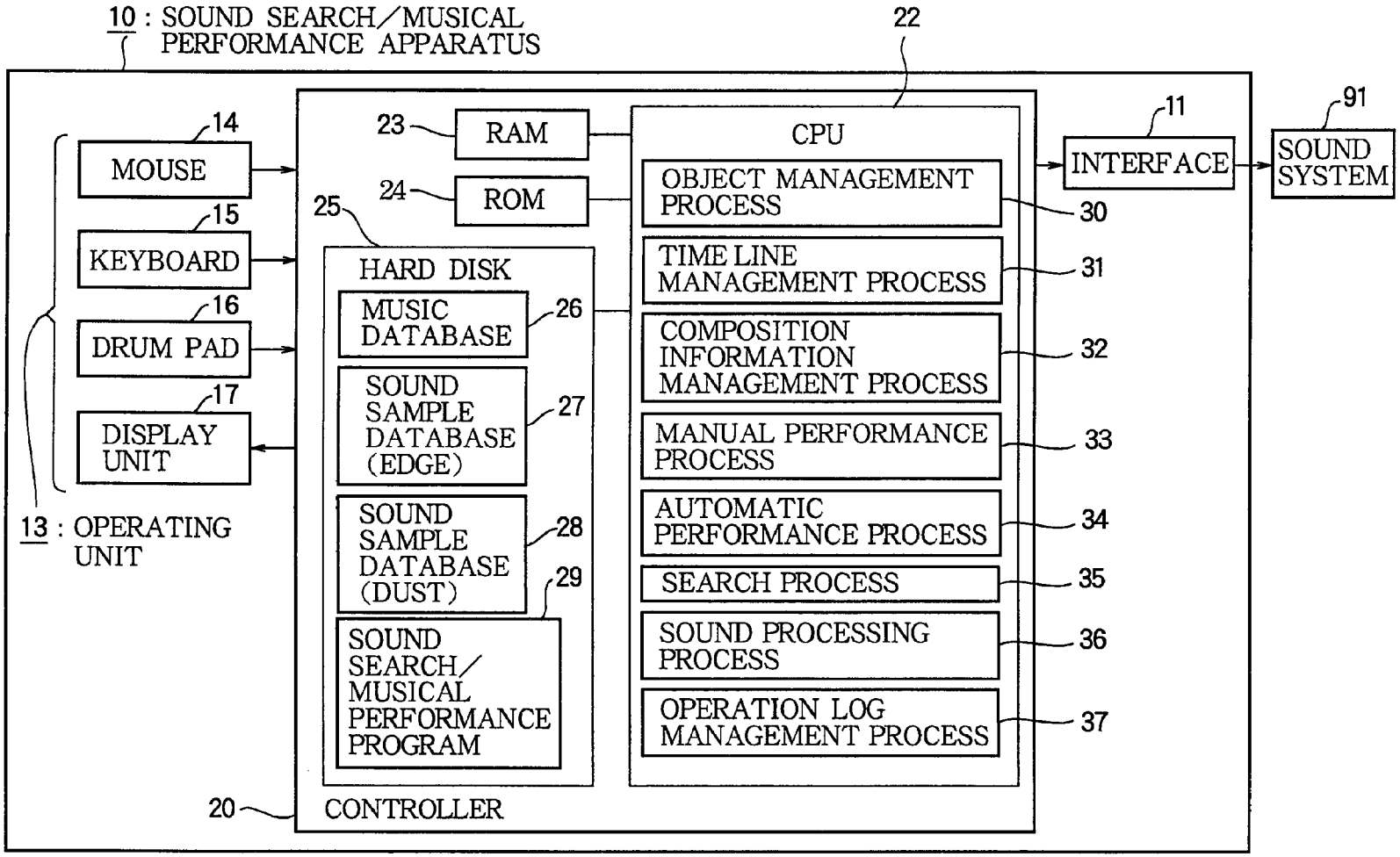
FIG. 1 is a block diagram illustrating a configuration of a sound search/musical performance apparatus according to a first embodiment of the invention.

FIG. 1 is a block diagram illustrating a configuration of a sound search/musical performance apparatus 10 according to a first embodiment of the invention. The sound search/musical performance apparatus 10 is implemented by installing a sound search/musical performance program 29 according to this embodiment on a personal computer. The sound search/musical performance program 29 is an application software product similar to a so-called loop sequencer and has functions to search for sound samples, which are used for creating a piece of music, in a database according to an operation performed by a user, to compose a piece of music using the retrieved sound samples, and to perform the composed piece of music. The term "sound sample" in this embodiment refers to a sound waveform of a segment corresponding to one beat in a piece of music or a sound waveform of one of the segments or sections into which one beat is further divided. The sound search/musical performance program 29 in this embodiment employs a Graphical User Interface (GUI) which is absent in the conventional loop sequencer and which includes GUI elements that are referred to as "objects" and "time lines". That is, this embodiment is characterized by a GUI including objects and time lines. Details of the GUI will be described later.

As shown in FIG. 1, the sound search/musical performance apparatus 10 is connected to a sound system 91 through an interface 11. An operating unit 13 in this sound search/musical performance apparatus 10 includes a mouse 14, a keyboard 15, and a drum pad 16. A display unit 17 is, for example, a computer display.

A controller 20 includes a CPU 22, a RAM 23, a ROM 24, and a hard disk 25. The CPU 22 executes a program stored in the ROM 24 or the hard disk 25 using the RAM 23 as a work area. The ROM 24 is a read only memory in which an initial program loader or the like is stored.

The hard disk 25 is a machine readable medium that stores a music database 26, sound sample databases 27 and 28, and a sound search/musical performance program 29.

The music database 26 is a database in which music data md-k (k=1, 2, . . . ) is stored. Each item of the music data md-k (k=1, 2, . . . ) is data representing sound waveforms of one piece of music. Each item of the music data md-k (k=1, 2, . . . ) is assigned an individual music number k.

FIG. 2 is a data structure diagram of the sound sample databases 27 and 28. The sound sample database 27 is a collection of records corresponding respectively to sound samples (hereinafter referred to as "edge sounds"), each of which has a clear attack and provides a strong edge feeling, among sound samples included in the music data md-k (k=1, 2, . . . ). The sound sample database 28 is a collection of records corresponding respectively to sound samples (hereinafter referred to as "dust sounds"), each of which has a clear attack and provides a strong dusty feeling, among the sound samples included in the music data md-k (k=1, 2, . . . ). The sound sample databases 27 and 28 are generated by analyzing the music data md-k (k=1, 2, . . . ) of the music database 26 through a feature quantity analysis program (not shown).

More specifically, in the sound sample database 27, a record corresponding to one edge sound includes nine fields respectively representing the music number k of music data md-k, which includes the edge sound, respective times $t_S$ and $t_E$ of start and end points of a segment including the edge sound within a sound waveform of one piece of music represented by the music data md-k, and the following six types of feature quantities obtained by analyzing a sound waveform (i.e., a sound sample) of the segment or section including the edge sound.

a1. Low Band Intensity $P_{LOW}$

This is the intensity of low band frequency components included in the sound sample.

b1. Middle Low Band Intensity $P_{MID\text{-}LOW}$

This is the intensity of middle low band frequency components included in the sound sample.

c1. Middle High Band Intensity $P_{MID\text{-}HIGH}$

This is the intensity of middle high band frequency components included in the sound sample.

d1. High Band Intensity $P_{HIGH}$

This is the intensity of high band frequency components included in the sound sample.

e1. Peak Position $P_{TIME}$

This is the time, at which the amplitude of the waveform peaks, expressed relative to the time $t_S$.

f1. Peak Intensity $P_{VALUE}$

This is the amplitude of the peak of the sound sample.

Similarly, in the sound sample database 28, a record corresponding to one dust sound includes nine fields respectively representing the music number k of music data md-k, which includes the dust sound, the times $t_S$ and $t_E$ of start and end points of a section including the dust sound within a sound waveform of one piece of music represented by the music data md-k, and the above six types of feature quantities ($P_{LOW}$, $P_{MID\text{-}LOW}$, $P_{MID\text{-}HIGH}$, $P_{HIGH}$, $P_{TIME}$, and $P_{VALUE}$) obtained by analyzing a sound sample of the section including the dust sound.

In FIG. 1, the sound search/musical performance program 29 is a program causing the CPU 22 to perform eight types of processes, i.e., an object management process 30, a time line management process 31, a composition information management process 32, a manual performance process 33, an automatic performance process 34, a search process 35, a sound processing process 36, and an operation log management process 37. In FIG. 1, the sound search/musical performance program 29 provides a GUI including objects and a time line(s) to the user as described above. The following is an overview of the GUI.

First, an object is a graphical symbol or pattern image representing a search condition of a sound sample, for which the user desires to perform sound generation. In this embodiment, the user may create a number of objects corresponding to one type of the sound sample, for which the user desires to perform sound generation. The shape or form of the object represents a search condition of a sound sample that has been associated with the object. By operating the operating unit 13, the user can change the search condition of the sound sample associated with the object and can change the shape of the object in association with the changed search condition.

Next, a time line is a linear image representing a period of a phrase which is a series of one or a plurality of sound samples that are periodically repeated in a piece of music. The time line may represent one measure or may also represent a plurality of measures. In this embodiment, composition of a phrase is performed by displaying a time line and one or more of objects on the display unit 17 and allocating one or more of objects to the time line (i.e., defining or determining belongingness of one or more of objects to the time line). In this case, each of the one or more of objects assigned to the time line specifies a search condition and a sound generation timing of a sound sample, sound generation of which is performed in one period (phrase) represented by the time line. In this embodiment, it is also possible to use a plurality of time lines when performing composition of music piece. In this case, the time lines represent respective periods of a plurality of phrases that are played simultaneously for a piece of music that is to be composed. An individual object may be assigned to each time line and a common object may also be assigned commonly to each time line.

As described above, the sound search/musical performance program 29 is a program causing the CPU 22 to perform the eight types of processes, i.e., the object management process 30, the time line management process 31, the composition information management process 32, the manual performance process 33, the automatic performance process 34, the search process 35, the sound processing process 36, and the operation log management process 37. The object management process 30 is a process for generating, changing, and storing an object according to an operation of the operating unit 13. The time line management process 31 is a process for generating and changing a time line according to operation of the operating unit 13. The composition information management process 32 includes a process for storing layout information of a time line and an object displayed on the display unit 17 as music data and a process for reproducing a time line and an object on the display unit 17 based on the stored music data.

The manual performance process 33 is a process for performing sound generation of a sound sample that matches a search condition represented by an object according to a manual trigger through operation of the drum pad 16 or the like. The automatic performance process 34 shares, with the object management process 30, information regarding the on-screen layout and the contents of an object displayed on the display unit 17 and shares, with the time line management process 31, information regarding the on-screen layout and the contents of a time line displayed on the display unit 17.

The automatic performance process 34 is a process for carrying out automatic performance of one or a plurality of phrases according to one or a plurality of objects and one or a plurality of time lines displayed on the display unit 17.

The search process 35 is a process for searching for a sound sample according to a search condition that has been associated with a specified object and is activated as a subroutine in the object management process 30, the manual performance process 33, and the automatic performance process 34. The sound processing process 36 is a process for changing a parameter included in a sound sample corresponding to an object when sound generation of the sound sample is performed and is activated as a subroutine in the automatic performance process 34. The operation log management process 37 includes a process for recording an operation log of the operating unit 13 used to perform generation, change, etc., of an object or a time line and a process for reading the recorded operation log and reproducing each operation indicated by the operation log.

The above description has been given of details of the configuration of the sound search/musical performance apparatus 10.

In this embodiment, a piece of music is created through a sound sample determination task for determining a sound sample, which is used to create a piece of music, and a sample arrangement task for mapping the determined sound sample onto the time axis of one or a plurality of phrases.

The following is a description of an operation of this embodiment in the sample determination task and the sample arrangement task.

(1) Sample Determination Task

In the sample determination task, the user selects one of two search settings (i.e., first and second search settings), which determine search timings of a sound sample, and performs an object development operation, a search condition specifying operation, a manual performance operation, an object storage operation, and the like. The first search setting is a search setting in which sound sample search is performed in the music database 26 each time the search condition associated with the object has changed. The second search setting is a search setting in which, each time sound generation of the sound sample represented by the object is performed, sound sample search is performed in the music database 26 before the sound generation.

First, the user performs an object development operation. The object development operation is an operation for developing (i.e., displaying) an image of an object ob-n (n=1, 2 . . . ) in a display region of the display unit 17. As described above, the object ob-n is a graphical image representing a sound sample included in a phrase of a piece of music. Through the object development operation, it is also possible to designate, as a development target, an object ob-n that has been previously created and stored in the hard disk 25 and to designate, as a development target, a default object (i.e., an object ob-n having a predetermined standard search condition) prepared in the sound search/musical performance program 29.

Through the object development operation, it is also possible to designate an object ob-n of an edge sound as a development target and to designate an object ob-n of a dust sound as a development target. In the object management process 30, the object ob-n designated through the object development operation is displayed on the display unit 17 and object management information associated with the object ob-n is written to the RAM 23. The object management information includes the requested number of searches Num (1≤Num) and feature quantities $P_{LOW}$, $P_{MID\text{-}LOW}$, $P_{MID\text{-}HIGH}$, $P_{HIGH}$, $P_{TIME}$, and $P_{VALUE}$, which constitute the search condition SC-n of the sound sample represented by the shape or form of object ob-n. In some case, the object management information may accompany a search result SR-n that is a set of sound samples obtained through search using the search condition SC-n.

Figure 3:
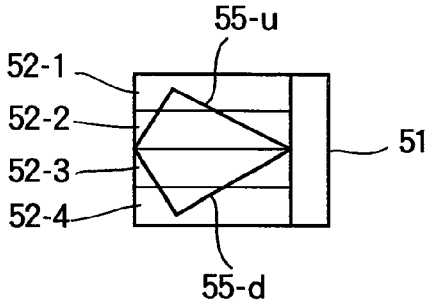
FIGS. 3(A) and 3(B) illustrate objects of an edge sound and a dust sound displayed in a display region of a display unit of the sound search/musical performance apparatus.
Figure 3:
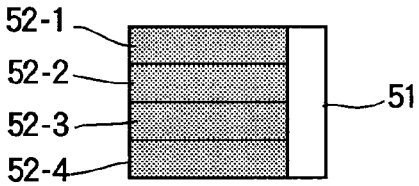

As shown in FIG. 3(A), an object ob-n of an edge sound forms a rectangle in its entirety and includes a vertical stripe region 51 present at the right side of the rectangle and four horizontal stripe regions 52-*m* (m=1~4) into which a left portion of the vertical stripe region 51 is equally divided horizontally. In the object ob-n, horizontally symmetrical lower triangles 55-*u* and 55-*d*, each of which simulates an edge sound, are displayed in an overlapping manner on the horizontal stripe regions 52-1 and 52-2 and the horizontal stripe regions 52-3 and 52-4, respectively. Here, the horizontal position (i.e., position in the horizontal direction) of each of the upper and lower vertices of the triangles 55-*u* and 55-*d* represents a peak position $P_{TIME}$ of the edge sound represented by the object ob-n. That is, sharpness feeling of the edge sound increases as each of the upper and lower vertices of the triangles 55-*u* and 55-*d* approaches the left side and sharpness feeling of the edge sound decreases as each of the upper and lower vertices of the triangles 55-*u* and 55-*d* approaches the right side. In addition, the height of each of the upper and lower vertices of the triangles 55-*u* and 55-*d* represents the peak intensity $P_{VALUE}$ of the peak of the edge sound. That is, edge feeling of the edge sound increases as the height of each of the upper and lower vertices of the triangles 55-*u* and 55-*d* increases and edge feeling of the edge sound decreases as the height of each of the upper and lower vertices of the triangles 55-*u* and 55-*d* decreases.

The respective densities (or degrees of darkness) of display colors of the horizontal stripe regions 52-*m* (m=1~4) represent the high band intensity $P_{HIGH}$, the middle high band intensity $P_{MID\text{-}HIGH}$, the middle low band intensity $P_{MID\text{-}LOW}$, and the low band intensity $P_{LOW}$ of the edge sound represented by the object ob-n. That is, the high band intensity of the edge sound is high, for example, when the display color of the horizontal stripe region 52-1 is dark and the middle band intensity of the edge sound is higher than the high band intensity, for example, when the display color of the horizontal stripe region 52-1 is light and the display color of the horizontal stripe region 52-2 is dark.

As shown in FIG. 3(B), the object ob-n of the dust sound has a form in which a grainy figure simulating the dust sound is superimposed on a portion including the horizontal stripe regions 52-*m* (m=1~4) and the vertical stripe region 51. Similar to the object ob-n of the edge sound, respective densities of display colors of the horizontal stripe regions 52-*m* (m=1~4) represent the high band intensity $P_{HIGH}$, the middle high band intensity $P_{MID\text{-}HIGH}$, the middle low band intensity $P_{MID\text{-}LOW}$, and the low band intensity $P_{LOW}$ of the dust sound represented by the object ob-n.

The user can perform a search condition specifying operation, an objet storage operation, or the like for each object ob-n after displaying one or a plurality of objects ob-n in the display region of the display unit 17 through an object development operation.

The search condition specifying operation is an operation for specifying a search condition SC-n of a sound sample associated with an object ob-n. The following are such search condition specifying operations.

<Operation for Specifying Peak Position $P_{TIME}$ and Peak Intensity $P_{VALUE}$ of Edge Sound>

Figure 4:
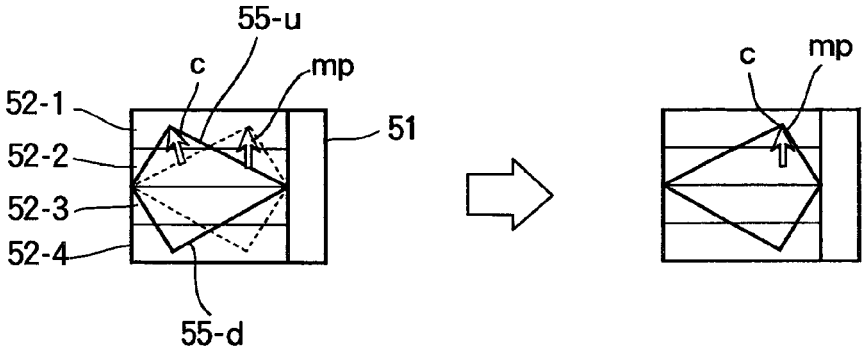
FIG. 4 illustrates an operation for instructing change of the shape of an object in the display region.

Through this operation, the user operates the shapes of the triangles 55-*u* and 55-*d* of the object ob-n. Specifically, as shown in FIG. 4, the user depresses a left mouse button after moving a mouse pointer mp to a vertex C of one (for example, the triangle 55-*u*) of the triangles 55-*u* and 55-*d* of an object ob-n of an edge sound and releases the left mouse button after moving the mouse pointer mp in an arbitrary direction with the left mouse button depressed. In the object management process 30, the CPU 22 changes the shapes of the triangles 55-*u* and 55-*d* and the peak position and intensity $P_{TIME}$ and $P_{VALUE}$ in a cooperative (or associated) manner according to this operation. That is, the position of each of the vertices of the triangles 55-*u* and 55-*d* is equal to the position of the mouse pointer mp at the time when the operation is terminated and the distance of each of the vertices of the triangles 55-*u* and 55-*d* from the left side of the object ob-n represents an updated peak position $P_{TIME}$, and the height of each vertex represents an updated peak intensity $P_{VALUE}$.

<Operation for Specifying High Band Intensity $P_{HIGH}$, Middle High Band Intensity $P_{MID\text{-}HIGH}$, Middle Low Band Intensity $P_{MID\text{-}LOW}$, and Low Band Intensity $P_{LOW}$ of Edge Sound and Dust Sound>

Figure 5:
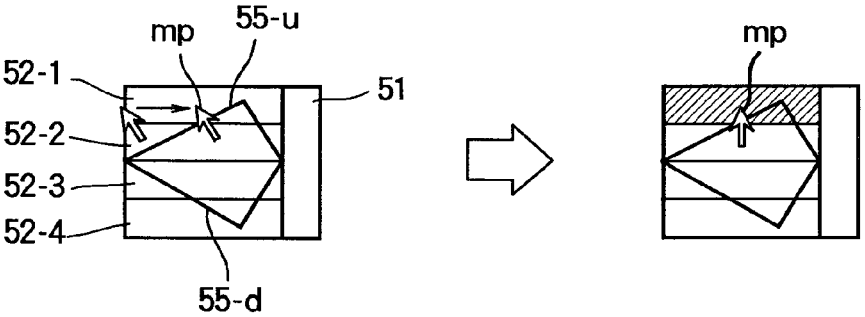
FIG. 5 illustrates an operation for instructing change of the shape of an object in the display region.

In this case, as shown in FIG. 5, the user depresses a key (for example, a shift key) on the keyboard 15 after moving the mouse pointer mp to one (for example, the horizontal stripe region 52-1 in the example of FIG. 5) of the horizontal stripe regions 52-*m* (m=1~4) of the object ob-n and releases the key after moving the mouse pointer mp in a right direction with the key depressed. For example, when this operation has been performed on the horizontal stripe region 52-4, the CPU 22 updates, in the object management process 30, the density of the display color of the horizontal stripe region 52-4 and the low band intensity $P_{LOW}$ in a cooperative manner according to the amount of movement of the mouse pointer mp in the right direction. The same is true for operations of specifying the high band intensity $P_{HIGH}$, the middle high band intensity $P_{MID\text{-}HIGH}$, and the middle low band intensity $P_{MID\text{-}LOW}$.

<Operation for Specifying the Requested Number of Searches Num of Edge Sound and Dust Sound>

Figure 6:
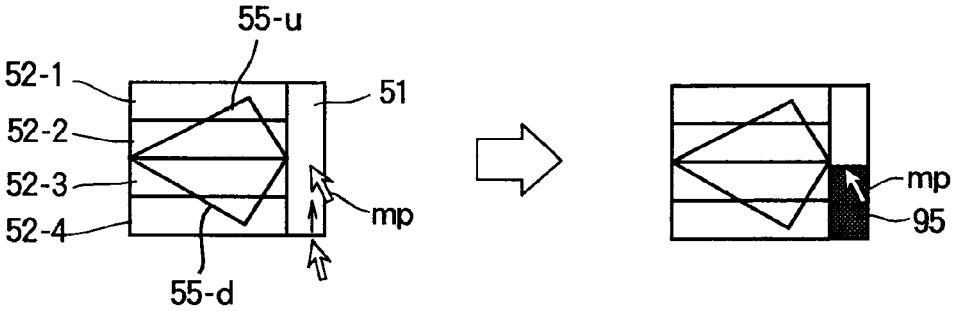
FIG. 6 illustrates an operation for instructing change of the shape of an object in the display region.

In this case, as shown in FIG. 6, the user depresses a key (for example, a shift key) on the keyboard 15 after moving the mouse pointer mp to a lower portion of the vertical stripe region 51 of the object ob-n and releases the key after moving the mouse pointer mp in an upward direction with the key depressed. For example, when this operation has been performed, the CPU 22 displays, in the object management process 30, a bar 95, which extends upward from the bottom of the vertical stripe region 51, in the vertical stripe region 51 and updates the height of the bar 95 of the vertical stripe region 51 and the requested number of searches Num in a cooperative manner according to the amount of movement of the mouse pointer mp in the upward direction.

Under the first setting, each time the search condition SC-n associated with the object is changed, the object management process 30 activates the search process 35 and causes the search process 35 to search for a sound sample meeting the new search condition SC-n in the object.

For example, when the search process 35 has been activated due to change of a search condition SC-n associated with an object ob-n of an edge sound, in the search process 35, the CPU 22 reads the requested number of searches Num and feature quantities $P_{LOW}$, $P_{MID\text{-}LOW}$, $P_{MID\text{-}HIGH}$, $P_{HIGH}$, $P_{TIME}$, and $P_{VALUE}$, which constitute the search condition SC-n, from the RAM 23. Then, the CPU 22 searches for top Num records in the order of increasing Euclidean distance from a six-dimensional feature quantity vector represented by the feature quantities $P_{LOW}$, $P_{MID\text{-}LOW}$, $P_{MID\text{-}HIGH}$, $P_{HIGH}$, $P_{TIME}$, and $P_{VALUE}$ in the sound sample database 27. The CPU 22 then locates a sound sample corresponding to each of the top Num records. That is, for each record, the CPU 22 identifies music data md-k of the same music number k as that of a music number k field in the record and locates, in this music data md-k, for a sound sample of a section between a start point and an end point represented by time $t_S$ and $t_E$ fields of the record. Then, the CPU 22 associates the top Num records and the top Num sound samples, found in the above manner, as a search result SR-n with the object ob-n. The same is true when a search condition SC-n associated with an object ob-n of a dust sound has changed.

The user may perform a manual performance operation in order to check whether or not a sound sample having desired features or characteristics has been associated with the object ob-n. This manual performance operation is an operation for generating a manual trigger to generate sound of the sound sample associated with the object ob-n through the sound system 91. While it is possible to set an appropriate manual trigger to be used on the sound search/musical performance program 29, it is assumed in this example that an event of operating the drum pad 16 has been set as a manual trigger. In this case, the user conducts the manual performance process 33 by moving the mouse pointer mp to the object ob-n and striking the drum pad 16.

In the manual performance process 33 under the first search setting, each time the drum pad 16 is struck, the CPU 22 selects one sound sample from the sound samples (i.e., the top Num sound samples described above) which are included in the search result SR-n associated with the object ob-n indicated by the mouse pointer mp and generates sound of the selected sound sample through the sound system 91.

In the manual performance process 33 under the second search setting, each time the drum pad 16 is struck, the CPU 22 activates the search process 35 and transfers the search condition SC-n associated with the object ob-n indicated by the mouse pointer mp to the search process 35. Then, the CPU 22 randomly selects one sound sample from the sound samples (i.e., the top Num sound samples described above) which are included in the search result SR-n obtained through the search process 35 and generates sound of the selected sound sample through the sound system 91. The user listens to the generated sound of the sound sample and again performs a search condition specifying operation for the object ob-n when the sound sample does not have desired characteristics or features.

The user may perform an object storage operation when the object ob-n in the display region of the display unit 17 is expected to be reused at a later time. This is an operation of the operating unit 13 for instructing storage of the object ob-n in the display region of the display unit 17. When an object storage operation has been performed for an object ob-n, the CPU 22 generates, in the object management process 30, object management information of the object ob-n and stores the generated object management information in the hard disk 25. The object management information is a set of the requested number of searches Num and feature quantities $P_{LOW}$, $P_{MID\text{-}LOW}$ $P_{MID\text{-}HIGH}$, $P_{HIGH}$, $P_{TIME}$, and $P_{VALUE}$ included in a search condition SC-n of the object ob-n and records included in a search result SR-n thereof.

As described above, in the sample determination task, the user searches for a sound sample close to a sound desired by the user in the music database 26 and the sound sample databases 27 and 28 while changing the requested number of searches Num and the feature quantities $P_{LOW}$, $P_{MID\text{-}LOW}$, $P_{MID\text{-}HIGH}$, $P_{HIGH}$, $P_{TIME}$, $P_{VALUE}$ included in the search condition SC-n by changing the shape or form of the object ob-n in the display region of the display unit 17. The user determines a number of objects ob-n (n=1, 2, . . . ) required to create a piece of music and respective shapes of the objects ob-n (n=1, 2, . . . ) and stores the object management information of the objects ob-n (n=1, 2, . . . ) as needed and moves to the subsequent sample arrangement task.

(2) Sample Arrangement Task

In the sample arrangement task, using the operating unit 13, the user displays one or a plurality of desired time lines and one or a plurality of desired objects in the display region of the display unit 17 and adjusts the relative positions or the like between the time lines and the objects so that the time lines and the objects have a desired positional relationship to establish the belongingness of the object to the time line. To accomplish this, the user performs an object development operation, an object copy operation, a search condition specifying operation, a time line development operation, a time line position change operation, an object position change operation, a size change operation, a meter designation operation, a grid specifying operation, a parameter cooperation operation, a musical performance start operation, a layout storage operation, a layout read operation, a log recording start operation, a log recording end operation, and a log reproduction operation.

Figure 7:
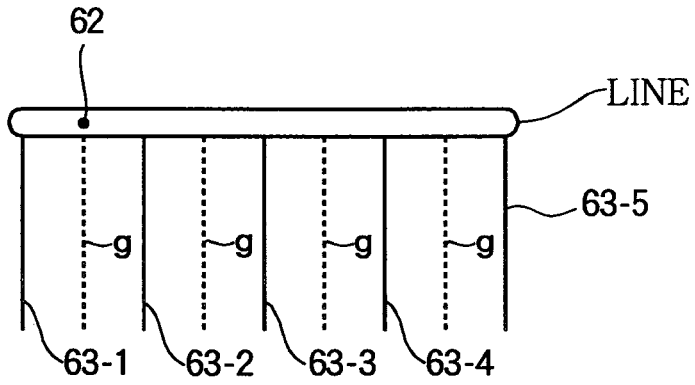
FIG. 7 illustrates a time line displayed in the display region.

When the time line development operation has been performed, in the time line management process 31, the CPU 22 displays a time line LINE-i illustrated in FIG. 7 in the display region of the display unit 17. This time line LINE-i is a linear image extending in a horizontal direction representing the period of a phrase. Beat guide lines 63-*j* (j=1~5) extend downward from left and right ends of the time line LINE-i and from positions on the time line LINE-i at which the time line LINE-i is divided into four equal parts. A grid line g extends downward from each position on the time line LINE-i at which a portion between each pair of adjacent beat guide lines 63-*j* is divided into two equal sub parts. A region sandwiched between the two beat guide lines 63-*j* at the left and right ends of the time line LINE-i is defined as an occupied region of the time line LINE-i which is under control of the time line LINE-i. Objects in the occupied region of the time line LINE-i are objects belonging to the time line LINE-i. The time line LINE-i also includes a timing pointer 62. The timing pointer 62 is a pointer indicating the current musical performance position during automatic performance and periodically repeats movement from the left end to the right end of the time line LINE-i when automatic performance is carried out.

By operating the operating unit 13, the user may cause the time line management process 31 to adjust the length of the beat guide line 63-*j* (j=1~5) or the horizontal length of the time line LINE-i in the display region of the display unit 17. By operating the operating unit 13, the user may also cause the time line management process 31 to adjust the period T of a phrase represented by the time line LINE-i, i.e., the time required for the timing pointer 62 to move from the left end to the right end of the time line LINE-i. In the time line management process 31, information of each time line LINE-i displayed on the display unit 17 such as a period T represented by the time line, the number of the beat guide lines 63-*j* (j=1~5) and the length of each beat guide line 63-*j*, the horizontal length of the time line LINE-i, and the horizontal and vertical positions of the time line LINE-i in the display region are managed according to operation of the operating unit 13.

Next, when no object ob-n to be allocated to the time line LINE-i is not displayed in the display region of the display unit 17, the user performs an object development operation for developing the object ob-n. Through the object development operation, object management information stored in the hard disk 25 may be read and displayed as an object ob-n. The user may also perform a search condition specifying operation for the object ob-n displayed in the display region of the display unit 17. In the object management process 30, information of each object ob-n displayed on the display unit 17 such as the horizontal and vertical positions of the object ob-n in the display region and a search result SR-n and a search condition SC-n associated with the object ob-n are managed through operation of the operating unit 13. In addition, when a search condition specifying operation has been performed for the object ob-n that is being displayed, the search result SR-n and the search condition SC-n associated with the object ob-n are updated in the object management process 30.

The user may perform a time line position change operation or an object position change operation using the operating unit 13 after displaying one or a plurality of time lines LINE-i and one or a plurality of objects ob-n in the display region of the display unit 17. When the user desires to assign or allocate an object ob-n to a time line LINE-i (i.e., define an object ob-n as belonging to a time line LINE-i), the user may adjust the position of the object ob-n so that the object ob-n enters the occupied region of the time line LINE-i. In this case, the user may also arrange a common object ob-n within respective occupied regions of a plurality of time lines LINE-i to allocate the common object ob-n to the plurality of time lines LINE-i.

The user may also extend a width of the time line LINE-i in the x-axis direction (parallel to the longitudinal direction of the time line LINE-i) or a width of the time line LINE-i in the y-axis direction (perpendicular to the longitudinal direction of the time line LINE-i) through a size change operation. The user may also increase or decrease the number of beat guide lines 63-*j* in the time line LINE-i above or below five through a meter designation operation or may increase the number of grid lines g between each pair of beat guide lines 63-*j* of the time line LINE-i above one through a grid specifying operation. By performing an operation for increasing the x-axis width of the time line LINE-i without performing an operation for changing the period T of the phrase represented by the time line LINE-i, the user may increase the size of the occupied region of the time line LINE-i to increase the degree of freedom of editing of the object ob-n in the occupied region.

In addition, by performing a parameter cooperation operation, the user may switch an operating mode relating to sound generation of the sound sample during automatic performance from a normal mode to a parameter linkage mode. Here, the parameter linkage mode is a mode in which, when sound generation of a sound sample corresponding to an object ob-n belonging to the time line LINE-i is performed, parameters of the sound sample (for example, pitch, volume, and the amount of delay of the sound generation timing) are changed according to a vertical distance from the time line LINE-i to the object ob-n. The normal mode is a mode in which sound generation of a sound sample corresponding to an object ob-n assigned to the time line LINE-i is performed without changing parameters of the sound sample.

The user may also perform an object copy operation as needed. This is an operation for copying (and pasting) the original object ob-n displayed in the display region of the display unit 17 within the display region. When an object copy operation has been performed for an original object ob-n, the CPU 22 displays a new object ob'-n having the same shape as the original object ob-n in the object management process 30. One or a plurality of copied objects ob'-n may be generated. Here, the original object ob-n and the copied object ob'-n are associated with a common search condition SC-n and search result SR-n. The user may assign not only the original object ob-n but also the copied object ob'-n to a desired time line LINE-i. Here, the object ob-n and the object ob'-n are identical and a given operation is applied equally to both the objects. That is, the CPU 22 updates a search condition SC-n synchronously to the object ob-n and the object ob'-n when a search condition specifying operation has been performed on one of the object ob-n and the object ob'-n.

The user performs a performance start operation using the operating unit 13 after determining the layout of the object ob-n and the time line LINE-i in the display region of the display unit 17 through the operations described above. When a performance start operation has been performed, the CPU 22 performs the automatic performance process 34. In the automatic performance process 34, the CPU 22 launches time line tasks tsk-i (i=1, 2 . . . ) corresponding respectively to the time lines LINE-i (i=1, 2 . . . ) displayed in the display region of the display unit 17 and performs the launched time line tasks tsk-i (i=1, 2 . . . ) in parallel and independently of the time lines.

In one time line task tsk-i corresponding to one time line LINE-i, the CPU 22 determines objects ob-n (n=1, 2, . . . ) assigned to the time line LINE-i (i.e., objects place in the occupied region of the time line LINE-i) and repeats control for generating a sound represented by each object ob-n belonging to the time line LINE-i every period T. The following are details of this procedure. First, in each time line task tsk-i, the CPU 22 monitors the x-coordinate value of the timing pointer 62 representing the longitudinal position of the time line LINE-i while repeatedly performing an operation for moving the timing pointer 62 from the left end to the right end of the time line LINE-i during the period T. Then, when the x-coordinate value of one of one or more of objects ob-n placed or located in the occupied region of the time line LINE-i (more specifically, the x-coordinate value of the left upper corner of a rectangle defining the outline of object ob-n) matches the x coordinate value of the timing pointer 62, the CPU 22 performs a process for performing sound generation of a sound sample corresponding to the object ob-n using, as the sound generation timing of the sound sample, the time at which the x-coordinate values of the object ob-n and the timing pointer 62 match.

More specifically, in a state where the first search setting has been done, in the time line task tsk-i, each time the x-coordinate value of the object ob-n belonging to the time line LINE-i matches the x coordinate value of the timing pointer 62, the CPU 22 reads a search result SR-n associated with the object ob-n and randomly selects a sound sample from sound samples included in the read search result SR-n and performs sound generation of the selected sound sample through the sound system 91. In a state where the second search setting has been done, in the time line task tsk-i, each time the x-coordinate value of the object ob-n belonging to the time line LINE-i matches the x coordinate value of the timing pointer 62, the CPU 22 activates the search process 35 and transfers a search condition SC-n of the object ob-n to the search process 35. Then, the CPU 22 randomly selects a sound sample from sound samples included in a search result SR-n returned from the search process 35 and performs sound generation of the selected sound sample through the sound system 91.

In the case where the parameter linkage mode has been set, each time a sound sample is selected from the search result SR-n, the CPU 22 activates the sound processing process 36 and processes the sound sample through the sound processing process 36 and performs sound generation of the processed sound sample through the sound system 91. Specifically, in the sound processing process 36, processing for changing parameters such as pitch, volume, and the amount of delay of the sound generation timing previously specified in association with the parameter linkage mode according to a distance from the time line LINE-i to the object ob-n is performed on the sound sample.

Various compositions performed using a time line LINE-i and objects ob-n and various modes of automatic performance of the compositions in this embodiment are described below with reference to specific examples.

Figure 8:
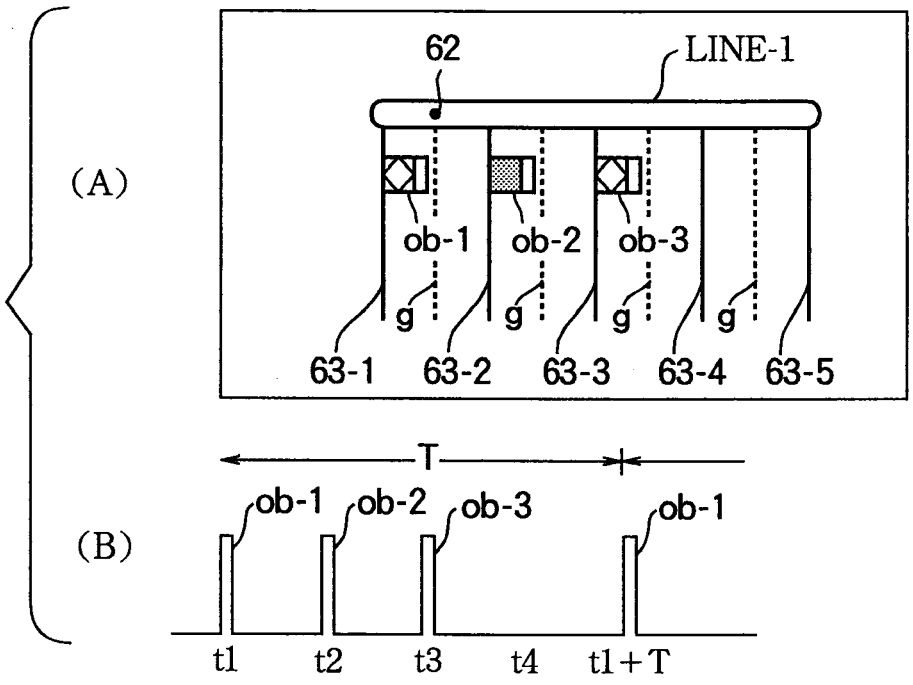
FIG. 8 illustrates an exemplary arrangement of a time line and objects in the display region and the contents of a piece of music created through the arrangement.

In an exemplary arrangement of FIG. 8(A), an object ob-1 is present at the right side of a leftmost beat guide line 63-1 of a time line LINE-1, an object ob-2 is present at the right side of a second leftmost beat guide line 63-2 of the time line LINE-1, and an object ob-3 is present at the right side of a third leftmost beat guide line 63-3 of the time line LINE-1. When the time line LINE-1 and the objects ob-n (n=1~3) have such a positional relationship, (in a time line task tsk-1 corresponding to the time line LINE-1) in the automatic performance process 34, the CPU 22 repeats a quadruple phrase which generates sounds of respective sound samples of the objects ob-n (n=1~3) at times t1, t2, and t3 from among times t1, t2, t3, and t4 at which the period T is divided into four equal parts as shown in FIG. 8(B).

Figure 9:
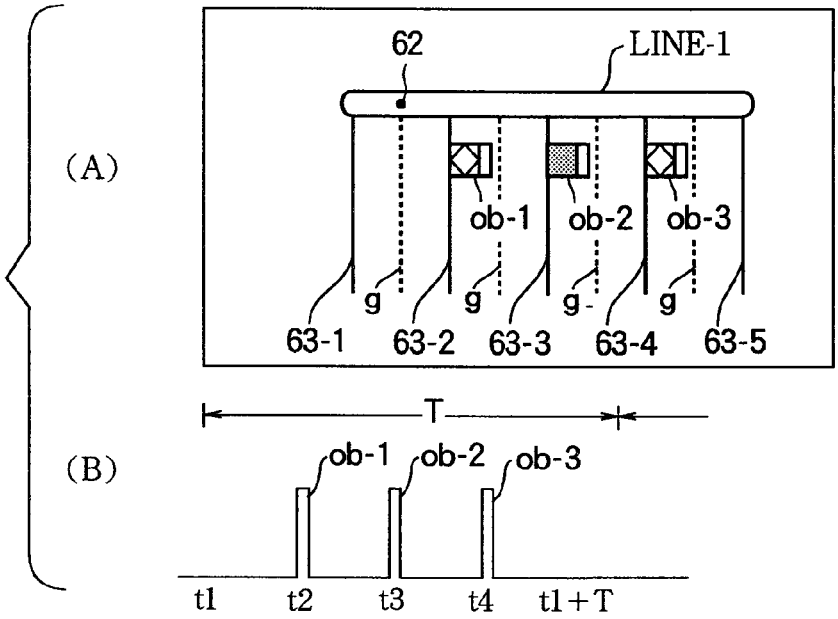
FIG. 9 illustrates an exemplary arrangement of a time line and objects in the display region and the contents of a piece of music created through the arrangement.

An exemplary arrangement of FIG. 9(A) is obtained by moving the objects ob-n (n=1~3) to the right with the position of the time line LINE-1 being fixed in the exemplary arrangement of FIG. 8(A). The exemplary arrangement of FIG. 9(A) is also obtained by moving the time line LINE-1 to the left with the positions of the objects ob-n (n=1~3) being fixed in the exemplary arrangement of FIG. 8(A). In the exemplary arrangement of FIG. 9(A), an object ob-1 is present at the right side of a beat guide line 63-2 of a time line LINE-1, an object ob-2 is present at the right side of a beat guide line 63-3, and an object ob-3 is present at the right side of a beat guide line 63-4. When the time line LINE-1 and the objects ob-n (n=1~3) have such a positional relationship, (in a time line task tsk-1 corresponding to the time line LINE-1) in the automatic performance process 34, the CPU 22 repeats a phrase which generates sounds of respective sound samples of the objects ob-n (n=1~3) at times t2, t3, and t4 as shown in FIG. 9(B).

Figure 10:
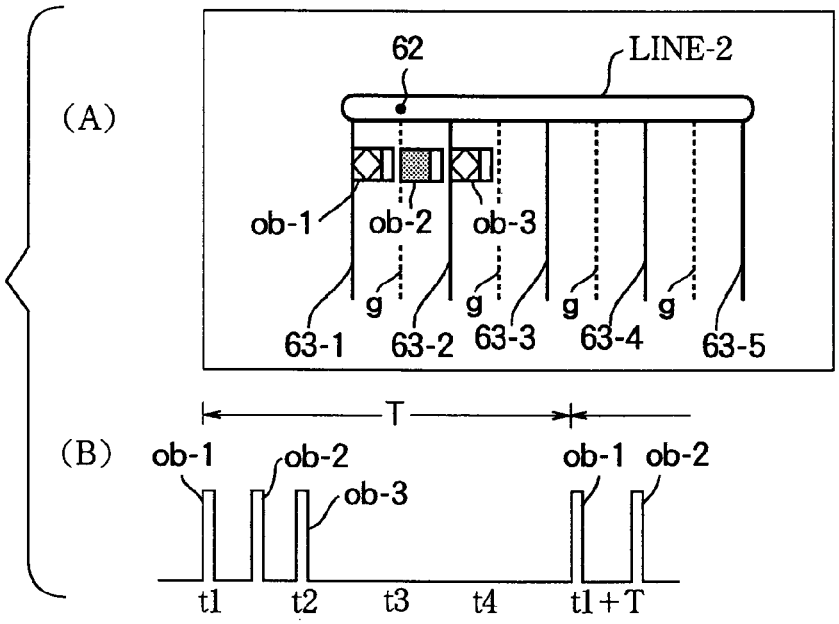
FIG. 10 illustrates an exemplary arrangement of a time line and objects in the display region and the contents of a piece of music created through the arrangement.

An exemplary arrangement of FIG. 10(A) is obtained by moving the objects ob-2 and ob-3 to the left with the positions of the object ob-1 and the time line LINE-1 being fixed in the exemplary arrangement of FIG. 8(A). In the exemplary arrangement of FIG. 10(A), an object ob-1 is present at the right side of a beat guide line 63-1, an object ob-2 is present at the right side of a grid line g between the beat guide line 63-1 and a beat guide line 63-2, and an object ob-3 is present at the right side of the beat guide line 63-2. When the time line LINE-1 and the objects ob-n (n=1~3) have such a positional relationship, (in a time line task tsk-1 corresponding to the time line LINE-1) in the automatic performance process 34, the CPU 22 repeats a phrase which generates sounds of respective sound samples of the objects ob-n (n=1~3) at times t1, (t1+t2)/2, and t2 as shown in FIG. 10(B).

In the sample arrangement task, the user may create a piece of music which periodically repeats two types of phrases including sound samples of the same search result SR-n by displaying two time lines LINE-i in the display region of the display unit 17 and arranging one or a plurality of objects ob-n in the display region so that the one or plurality of objects ob-n belong to both the two time lines LINE-i.

Figure 11:
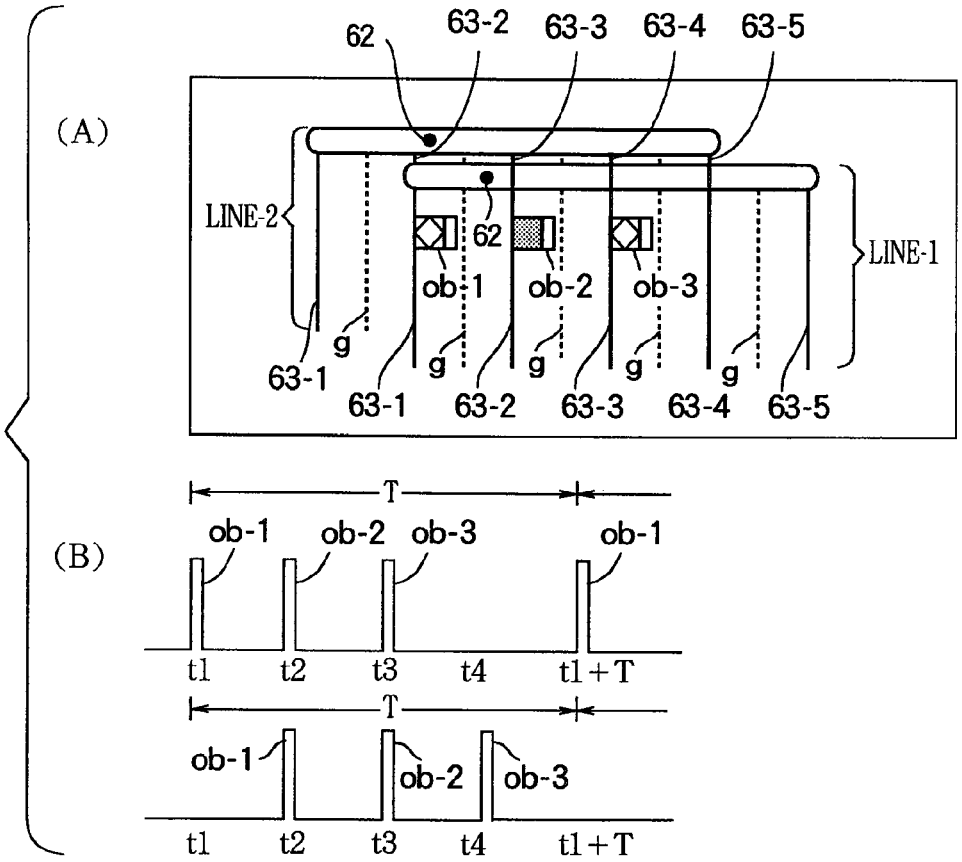
FIG. 11 illustrates an exemplary arrangement of a time line and objects in the display region and the contents of a piece of music created through the arrangement.

In an exemplary arrangement of FIG. 11(A), three objects ob-n (n=1~3) are present in the occupied region of two time lines LINE-j (j=1, 2) and the time line LINE-2 is out of alignment to the left with respect to the time line LINE-1. An object ob-1 is present at the right side of a beat guide line 63-1 of the time line LINE-1 (i.e., at the right side of a beat guide line 63-2 of the time line LINE-2), an object ob-2 is present at the right side of a beat guide line 63-2 of the time line LINE-1 (i.e., at the right side of a beat guide line 63-3 of the time line LINE-2), and an object ob-3 is present at the right side of a beat guide line 63-3 of the time line LINE-1 (i.e., at the right side of a beat guide line 63-4 of the time line LINE-2).

When the time lines LINE-j (j=1, 2) and the objects ob-n (n=1~3) have such a positional relationship, in the automatic performance process 34, the CPU 22 repeats, in a time line task tsk-1 corresponding to the time line LINE-1, a quadruple phrase which generates sounds of respective sound samples of the objects ob-n (n=1~3) at times t1, t2, and t3 from among times t1, t2, t3, and t4 at which the period T is divided into four equal parts as shown in FIG. 11(B). In addition, the CPU 22 repeats, in a time line task tsk-2 corresponding to the time line LINE-2, a quadruple phrase which generates sounds of respective sound samples of the objects ob-n (n=1~3) at the times t2, t3, and t4 as shown in FIG. 11(B).

In the sample arrangement task, the user may also create a piece of music in which "strong" and "weak" sounds are included in one phrase by setting the operating mode to a parameter linkage mode and changing the distance from each of a plurality of objects ob-n to the time line LINE-i within an occupied region of the time line LINE-i.

Figure 12:
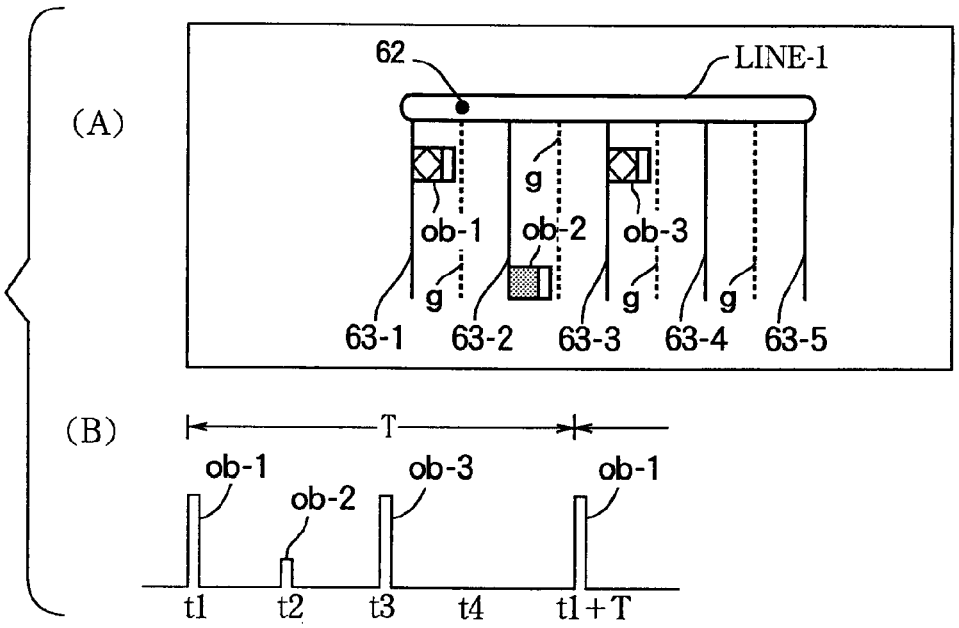
FIG. 12 illustrates an exemplary arrangement of a time line and objects in the display region and the contents of a piece of music created through the arrangement.

An exemplary arrangement of FIG. 12(A) is obtained by moving the object ob-2 located at the right side of the beat guide line 63-2 down to near the bottom of the beat guide line 63-2 in the exemplary arrangement of FIG. 8(A). Here, it is assumed that the automatic performance process 34 is performed in a state where the parameter linkage mode has been set and volume is a linkage target parameter. In this case, since the time line LINE-1 and the objects ob-n (n=1~3) have a positional relationship as shown in FIG. 12(A), in the sound processing process 36 activated in the automatic performance process 34 (i.e., activated in the time line task tsk-1 corresponding to the time line LINE-1), the CPU 22 increases the volumes of respective sound samples of the objects ob-1 and ob-3 located near the time line LINE-1 and decreases the volume of the sound sample of the object ob-2 located far from the time line LINE-1. As a result, the CPU 22 repeats a phrase which generates a sequence of strong, weak, and strong sounds of the sound samples of the objects ob-n (n=1~3) at times t1, t2, and t3 from among times t1, t2, t3, and t4 at which the period T is divided into four equal parts as shown in FIG. 12(B).

In the sample arrangement task, the user may also create a piece of music including two types of phrases, which include sound samples of the same search result SR-n and have different sound generation timings in the period T, by arranging one or a plurality of objects ob-n in the display region so that the one or plurality of objects ob-n belong to both two time lines LINE-i and decreasing or increasing the x-axis width of one of the two time lines LINE-i.

Figure 13:
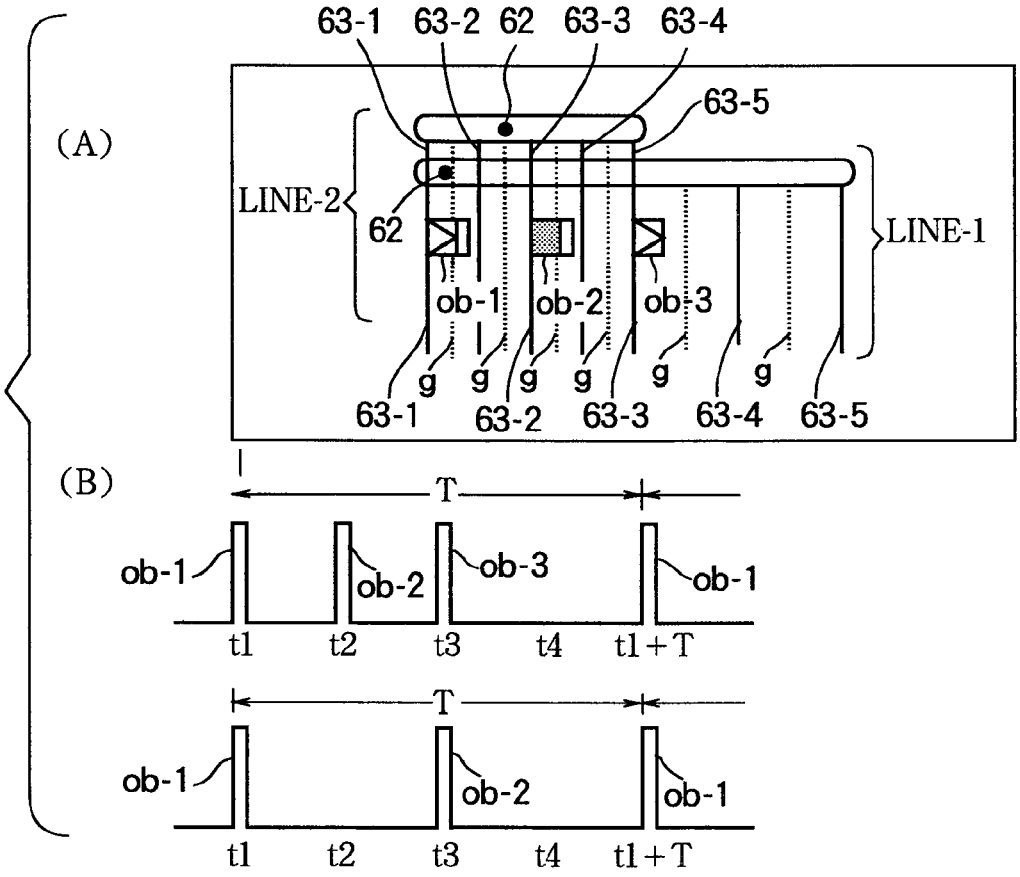
FIG. 13 illustrates an exemplary arrangement of a time line and objects in the display region and the contents of a piece of music created through the arrangement.

An exemplary arrangement of FIG. 13(A) is obtained by reducing by half the x-axis width of the time line LINE-2 in the exemplary arrangement of FIG. 11(A) and adjusting the x-axis positions of the time lines LINE-j (j=1, 2) so that the beat guide lines 63-1 of the time lines LINE-j (j=1, 2) overlap. In this exemplary arrangement, an object ob-3 located at the right side of a beat guide line 63-3 of the time line LINE-1 (and located at the right side of a rightmost beat guide line 63-5 of the time line LINE-2) belongs only to the time line LINE-1. Although the x-axis length of the time line LINE-2 in the display region is half of the x-axis length of the time line LINE-1, the period T of the phrase represented by the time line LINE-2 is equal to the period T of the phrase represented by the time line LINE-1.

When the time lines LINE-j (j=1, 2) and the objects ob-n (n=1~3) have such a positional relationship, in a time line task tsk-1 corresponding to the time line LINE-1 in the automatic performance process 34, the CPU 22 repeats a phrase which generates sounds of respective sound samples of the objects ob-1, ob-2, and ob-3 at times t1, t2, and t3 from among times t1, t2, t3, and t4 at which the period T is divided into four equal parts as shown in FIG. 13(B). In addition, in a time line task tsk-2 corresponding to the time line LINE-2, the CPU 22 repeats a phrase which generates sounds of respective sound samples of the objects ob-1 and ob-2 at the times t1 and t3 as shown in FIG. 13(B).

In the sample arrangement task, the user may create a piece of polyrhythm music that combines two types of phrases which include sound samples of the same search result SR-n and have different periods T or different meters by arranging one or a plurality of objects ob-n in the display region so that the one or plurality of objects ob-n belong to two time lines LINE-i and changing setting of the number of beats of one of the two time lines LINE-i to decrease or increase the number of beat guide lines 63-*j*.

Figure 14:
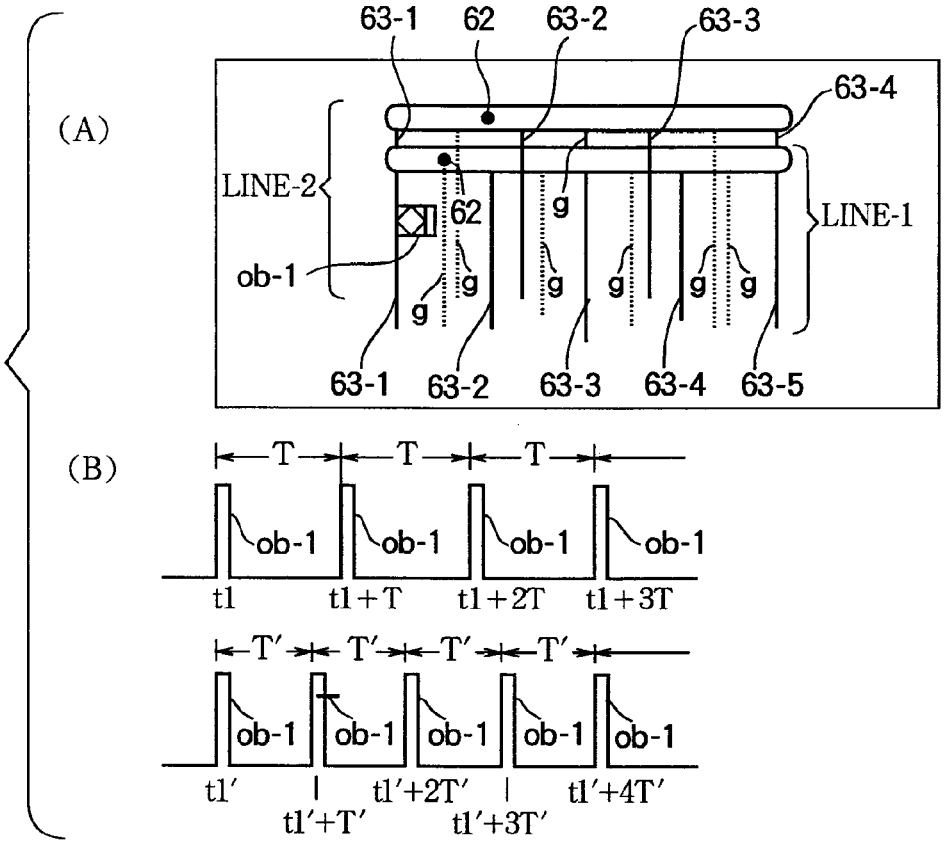
FIG. 14 illustrates an exemplary arrangement of a time line and objects in the display region and the contents of a piece of music created through the arrangement.

In an exemplary arrangement of FIG. 14(A), time lines LINE-1 and LINE-2 have the same horizontal lengths in the display region while the x-axis positions of the time lines LINE-1 and LINE-2 have been adjusted so that beat guide lines 63-1 of the time lines LINE-1 and LINE-2 overlap. Here, beat guide lines 63-2, 63-3, and 63-4 are present at positions at which the entirety of the time line LINE-1 is vertically divided into four equal parts. In addition, the number of beat guide lines of the time line LINE-2 is one less than the number of beat guide lines of the time line LINE-1 and beat guide lines 63-2 and 63-3 are present at positions at which the entirety of the time line LINE-2 is vertically divided into four equal parts. The length of a period T' of a phrase represented by the time line LINE-2 is ¾ of the length of a period T of a phrase represented by the time line LINE-1. The object ob-1 belongs to both the time lines LINE-1 and LINE-2 and is located at the right side of the beat guide lines 63-1 of the time lines LINE-1 and LINE-2.

When the automatic performance process 34 is performed in such a state, the CPU 22 repeats, in a time line task tsk-1 corresponding to the time line LINE-1 in the automatic performance process 34, a quadruple phrase which generates a sound of the sound sample of the object ob-1 at a time from among times t1, t2, t3, and t4 at which the period T is divided into four equal parts as shown in FIG. 14(B). In addition, in a time line task tsk-2 corresponding to the time line LINE-2, the CPU 22 repeats a triple phrase which generates a sound of the sound sample of the object ob-1 at a time t1' from among times t1', t2', and t3' at which the period T', which is ¾ths as long as the period T, is divided into three equal parts as shown in FIG. 14(B).

Figure 15:
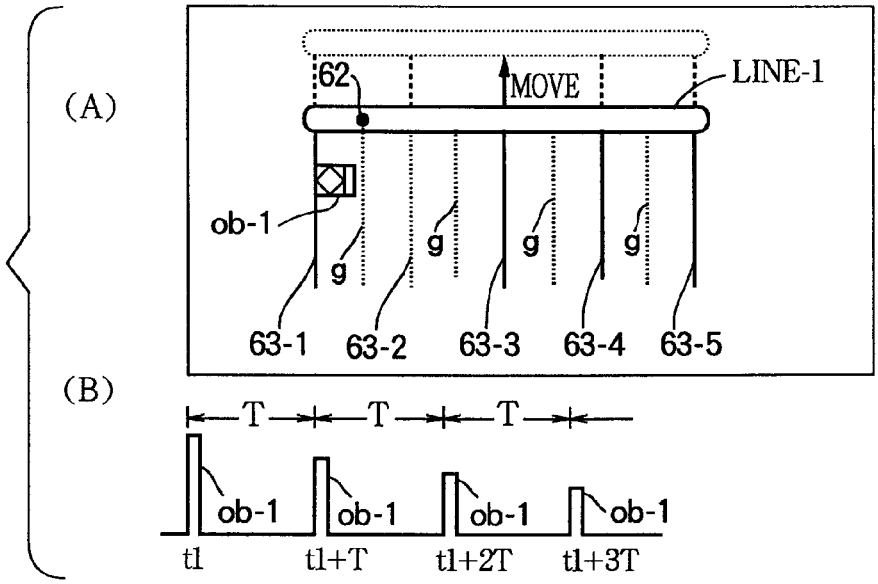
FIG. 15 illustrates an exemplary arrangement of a time line and objects in the display region and the contents of a piece of music created through the arrangement.

In this embodiment, the user may move the time line LINE-i while the automatic performance process 34 is being performed. When a time line position change operation has been performed on a time line LINE-i, the CPU 22 updates information regarding the position of the time line LINE-i in the time line management process 31. Information regarding the position of the time line LINE-i updated from moment to moment according to the time line position change operation is referenced in the automatic performance process 34. In an example illustrated in FIG. 15(A), a parameter linkage mode has been set and volume is set as a linkage target parameter. Accordingly, when the time line LINE-1 is moved upward away from the object ob-1 without changing the position of the object ob-1 as shown in FIG. 15(A), the CPU 22 gradually decreases the volume of the generated sound of the sound sample of the object ob-1 as shown in FIG. 15(B) as a result of the sound processing process 36 that is activated in the automatic performance process 34. In the case where the amount of delay of the sound generation timing has been set as a linkage target parameter in the parameter linkage mode, by moving the position of the time line LINE-1 upward during automatic performance, it is possible to obtain a pseudo-delay effect such that the sound generation timing of the sound sample of the object ob-1 is delayed according to the amount of upward movement of the time line LINE-1.

As is apparent from the above description, the contents of a piece of music are determined according to details of time lines and objects displayed on the display unit 17 and a relative positional relationship between the time lines and objects. That is, layout information of time lines and objects displayed on the display unit 17 serves as music data. This embodiment provides a means for enabling reuse of the music data. More specifically, the user may perform a layout storage operation using the operating unit 13 when the sample arrangement task is stopped. When the layout storage operation has been performed, the CPU 22 stores, in the composition information management process 32, the layout information of the time lines and the objects displayed in the display region of the display unit 17 in the hard disk 25. The layout information is a set of arrangement information representing the respective positions (x-coordinate values, y-coordinate values) of the objects ob-n (n=1, 2, . . . ) and the time lines LINE-i (i=1, 2, . . . ) in the display region and object management information (search conditions SC-n and search results SR-n) of the objects ob-n (n=1, 2, . . . ). The search conditions SC-n are associated to the forms of the sound objects, and the search results SR-n identify locations of the sound samples in the music data storage, which correspond to the sound objects.

In addition, the user may perform a layout read operation using the operating unit 13 when the task is resumed. When the layout read operation has been performed, the CPU 22 reads, in the composition information management process 32, the layout information stored in the hard disk 25 and extracts the arrangement information of the time lines and objects and the object management information from the read layout information. The CPU 22 displays, in the composition information management process 32, the time lines LINE-i (i=1, 2 . . . ) and the objects ob-n (n=1, 2, . . . ) at positions represented by the arrangement information and writes the requested number of searches Num and feature quantities $P_{LOW}$, $P_{MID\text{-}LOW}$, $P_{MID\text{-}HIGH}$, $P_{HIGH}$, $P_{TIME}$, and $P_{VALUE}$ included in the object management information, as a search condition SC-n, to the RAM 23. In this state, the user may further change the layout of the time lines LINE-i (i=1, 2 . . . ) and the objects ob-n (n=1, 2, . . . ) reconstructed in the display region of the display unit 17 through a time line movement operation or an object movement operation. The layout information, which is music data, may be transmitted to and used in another sound search/musical performance apparatus 10 other than the sound search/musical performance apparatus 10 in which the layout information has been created. In this case, when the contents of the music data database 26, the sound sample databases 27 and 28, or the like are different in the music data transmission source and transmission destination, details of automatic performance based on music data are different in the transmission source and the transmission destination. This is because there is a possibility that a sound sample found based on an object included in music data is different in the transmission source and the transmission destination.

In addition, in this embodiment, the user may perform a log record start operation and a log record end operation using the operating unit 13 at a desired time interval therebetween. When the user has performed a log record start operation, the CPU 22 generates, in the operation log management process 37, sequence data items representing respective movements of the time lines LINE-i (i=1, 2 . . . ) and the objects ob-n (n=1, 2, . . . ) in the display region until a log record end operation is performed after the log record start operation is performed, and records a set of the generated sequence data items as log information in the hard disk 25. When the user has performed a log reproduction operation, the CPU 22 reads, in the operation log management process 37, the log information stored in the hard disk 25 and reproduces respective movements of the time lines LINE-i (i=1, 2 . . . ) and the objects ob-n (n=1, 2, . . . ) in the display region according to the respective sequence data items included in the log information.

This embodiment described above can achieve the following advantages.

In this embodiment, the sound search/musical performance program 29 changes a search condition SC-n of a sound sample represented by an object ob-n in a display region of the display unit 17 and the shape of the object ob-n in a cooperative manner according to an operation of the operating unit 13. Thus, the user can determine the search condition SC-n, which the user is specifying for the object ob-n, from the shape of the object ob-n and can more simply search for a sound sample that matches the user's desires. In addition, when the user views an object ob-n at a later time, the user can easily visualize the features of a sound sample represented by the object ob-n or a search condition SC-n of the sound sample specified for the object ob-n from the shape of the object ob-n.

In this embodiment, in the case where a plurality of time lines LINE-i is displayed in the display region of the display unit 17, the sound search/musical performance program 29 performs sound generation of a piece of music including a plurality of types of phrases which correspond respectively to the plurality of time lines LINE-i and which overlaps in the time axis. In addition, in the case where an object ob-n in the display region belongs to a plurality of time lines LINE-i, times corresponding to the respective positions of the object ob-n in the x-axis direction of the plurality of time lines LINE-i are used as the sound generation timings of sounds corresponding to the object ob-n in the plurality of phrases. Accordingly, the user can create a piece of music including phrases having a plurality of periods, which overlap on the time axis, by arranging time lines LINE-i and objects ob-n in the display region of the display unit 17 so as to have a positional relationship such that one or a plurality of objects ob-n belong to a plurality of time lines LINE-i.

In addition, the user can continue the sample arrangement task using another computer, in which the sound search/musical performance program 29 has been installed, by copying object management information that has been stored in the hard disk 25 through an object storage operation, layout information that has been stored in the hard disk 25 through a layout storage operation, log information that has been stored in the hard disk 25 through a log storage operation, and the like to a hard disk 25 of the computer.

Further, during a sample arrangement task, the user can obtain music data md'-k (k=1, 2 . . . ) other than music data md-k (k=1, 2, . . . ), which is stored in the music database 26, and a group of records, which are analysis results of the md'-k (k=1, 2 . . . ), from another user and store the music data md'-k (k=1, 2, . . . ) and the group of records in the music database 26 and the sound sample databases 27 and 28, respectively, and then can continue the subsequent task. Even when a search condition SC-n specified as a shape of an object ob-n in the display region of the display unit 17 is the same, if the contents of the music database 26 or the sound sample databases 27 and 28 to be searched for are changed, then a sound sample obtained as a corresponding search result SR-n is also changed. Accordingly, the user can create a piece of music, in which the timing of generation of each sound of a phrase that is repeated every period T is the same and each sound sounds slightly different, by changing the contents of the music database 26 and the sound sample databases 27 and 28 without changing the layout of objects ob-n and time line LINE-i in the display region of the display unit 17.

Second Embodiment

The following is a description of a second embodiment of the invention. This embodiment is characterized by a GUI including objects ob-n and a time line matrix MTRX which is a collection of time lines LINE. The time line matrix MTRX is an image including M time lines LINE-i0 (i=1~4) (for example, M=4) extending in the x-axis direction (i.e., the horizontal direction) and N time lines LINE-0*j* (j=1~4) (for example, N=4) extending in the y-axis direction (i.e., the vertical direction) which intersect each other. In the time line matrix MTRX, a total of sixteen grid points gp-ij (i=1~4, j=1~4) are formed respectively at the intersections of the time lines LINE-i0 (i=1~4) and the time lines LINE-0*j* (j=1~4). Through operation of the operating unit 13, each of the time lines LINE-i0 and LINE-0*j* is switched from one of two states, an active state and an idle state, to the other state. The term "active state" refers to a state in which the time line serves as an image representing one phrase included in a piece of music and the term "idle state" refers to a state which in which the time line does not serve as an image representing one phrase included in a piece of music.

In this embodiment, composition of a phrase is performed by allocating one or a plurality of objects ob-n to one or plurality of time lines LINE-i0 and LINE-0*j* and switching all or part of the time lines to which the objects ob-n have been assigned from the idle state to the active state. Here, time lines which are in the idle state are referred to as "inactive time lines" and time lines which are in the active state are referred to as "active time lines".

In this embodiment, similar to the first embodiment, one piece of music is created through a sample determination task and a sample arrangement task. Operations of this embodiment in the sample determination task and the sample arrangement task are described as follows. In the sample determination task, the user performs an object development operation, a search condition specifying operation, a manual performance operation, an object storage operation, and the like and determines sound samples that are used to create a piece of music. When these operations have been performed, the CPU 22 performs the same processes as those of the first embodiment.

Figure 16:
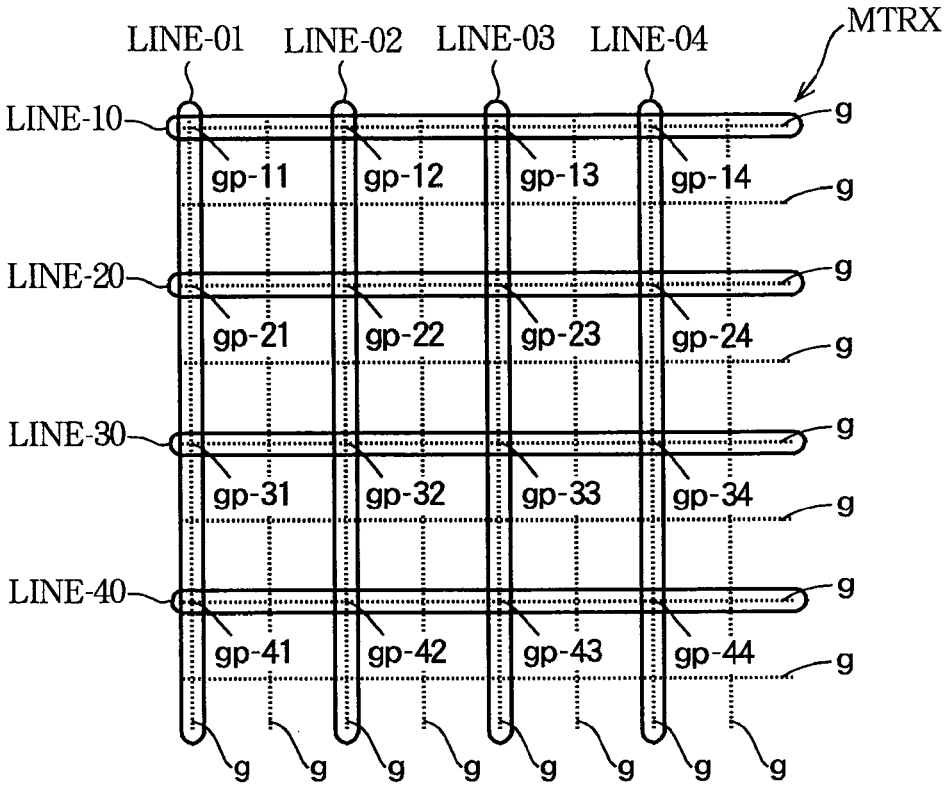
FIG. 16 illustrates a time line matrix displayed in a display region of a sound search/musical performance apparatus according to a second embodiment of the invention.

In the sample arrangement task, first, the user performs a time line matrix development operation. When the time line matrix development operation has been performed, the CPU 22 displays, in the time line management process 31, a time line matrix MTRX, which is a collection of inactive time lines, in the display region of the display unit 17. As shown in FIG. 16, time lines LINE-i0 (i=1~4) in the time line matrix MTRX are arranged in a vertical direction at intervals of ¼ of the length of each time line. Time lines LINE-0*j* (j=1~4) are also arranged in a horizontal direction at the same intervals as those of the time lines LINE-i0 (i=1~4).

More specifically, an uppermost time line LINE-10 from among the time lines LINE-i0 (i=1~4) intersects upper ends of the time lines LINE-0*j* (j=1~4) and grid points gp-1*j* (j=1~4) are formed at the intersections, respectively. A time line LINE-20 located below the time line LINE-10 intersects each of the time lines LINE-0*j* (j=1~4) at an uppermost division point from among three division points of the time line LINE-0*j*, at which the horizontal length of the time line LINE-0*j* may be divided into four equal parts, and grid points gp-2*j* (j=1~4) are formed at the intersections, respectively. A time line LINE-30 located below the time line LINE-20 intersects each of the time lines LINE-0*j* (j=1~4) at a middle division point from among the three division points of the time line LINE-0*j*, at which the entirety of the time line LINE-0*j* may be horizontally divided into four equal parts, and grid points gp-3*j* (j=1~4) are formed at the intersections, respectively. A time line LINE-40 located below the time line LINE-30 intersects each of the time lines LINE-0*j* (j=1~4) at a lowermost division point from among the three division points of the time line LINE-0*j*, at which the entirety of the time line LINE-0*j* may be horizontally divided into four equal parts, and grid points gp-4*j* (j=1~4) are formed at the intersections, respectively.

Grid lines g parallel to the time lines LINE-i0 (i=1~4) are present, respectively, at the time lines LINE-i0 (i=1~4), at positions at which portions between adjacent time lines LINE-i0 are each divided into equal parts, and at a position which is located below the time line LINE-40 at a distance therefrom, the distance being equal to the length of each of the two equal parts into which a portion between the time lines LINE-40 and LINE-30 is divided. In addition, grid lines g parallel to the time lines LINE-0*j* (j=1~4) are present, respectively, at the time lines LINE-0*j* (j=1~4), at positions at which portions between adjacent time lines LINE-0*j* are each divided into equal parts, and at a position which is located at the right side of the time line LINE-04 at a distance therefrom, the distance being equal to the length of each of the two equal parts into which a portion between the time lines LINE-04 and LINE-03 is divided.

Figure 17:
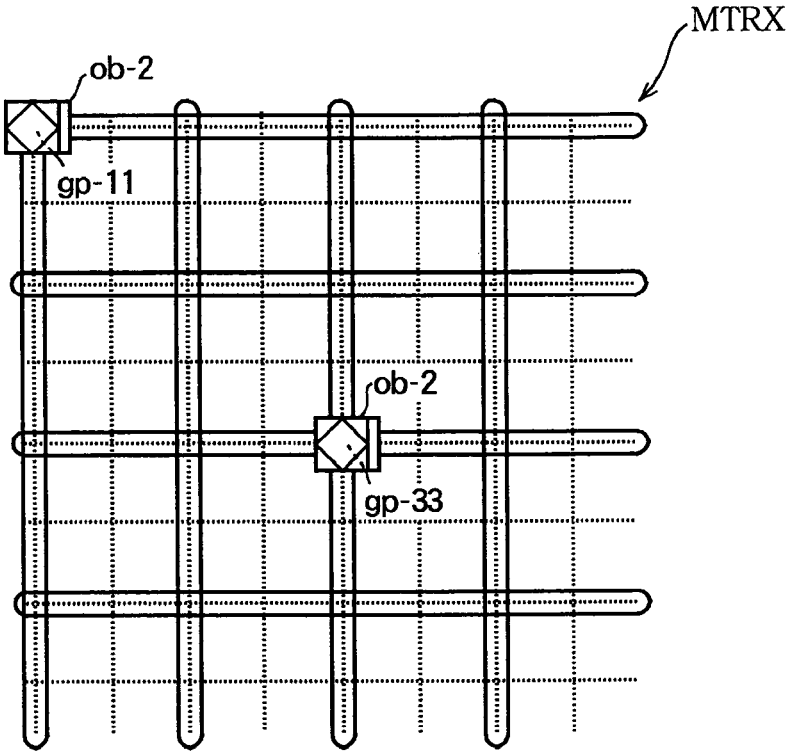
FIG. 17 illustrates an exemplary arrangement of a time line matrix and objects in the display region.

The user performs an object position change operation after displaying the time line matrix MTRX. As shown in FIG. 17, through the object position change operation, the user moves objects ob-n developed in the sample determination task onto grid points gp-ij (grid points gp-11 and gp-33 in the example of FIG. 17) in the time line matrix MTRX. Thereafter, through a time line switching operation, the user switches time lines intersecting at the grid points gp-ij, onto which the objects ob-n have moved, from among time lines LINE-i0 (i=1~4) and LINE-0*j* (j=1~4) from inactive time lines to active time lines. Here, the user may switch all or part of the time lines intersecting at the grid points gp-ij, onto which the objects ob-n have moved.

The CPU 22 performs an automatic performance process 34 while one or more time lines are active in the time line matrix MTRX. In the automatic performance process 34 in this embodiment, when an object ob-n is present at a grid point gp-ij in the time line matrix MTRX, the CPU 22 determines that the assignment relationship or belongingness of the object ob-n located at the grid point gp-ij with time lines LINE-i0 and LINE-0*j*, which intersect at the grid point gp-ij, is such that the time lines LINE-i0 and LINE-0*j* share the object ob-n located at the grid point gp-ij (i.e., such that the object ob-n located at the grid point gp-ij commonly belongs to the time lines LINE-i0 and LINE-0*j*).

More specifically, each time a time line LINE-i0 or LINE-0*j* in the time line matrix MTRX is switched from an inactive time line to an active time line, the CPU 22 launches a time line task tsk-i0 or tsk-0*j* corresponding to the time line LINE-i0 or LINE-0*j* and performs the launched time line task.

In one time line task tsk-i0 or tsk-0*j* corresponding to one time line LINE-i0 or LINE-0*j*, the CPU 22 determines that each object ob-n present at a grid point gp-ij of the time line belongs to the time line. Then, the CPU 22 repeats control for generating a sound represented by the object ob-n belonging to the time line every period T. Details of this process are as follows.

In the time line task tsk-i0 corresponding to the time line LINE-i0, the CPU 22 monitors the x coordinate value of the timing pointer 62 while periodically repeating an operation for moving the timing pointer 62 from a left end to a right end of the time line LINE-i0 during the period T. When the x-coordinate value of the object ob-n located at the grid point gp-ij of the time line LINE-i0 coincides with the x-coordinate value of the timing pointer 62, the CPU 22 performs a process for sound generation of a sound sample corresponding to the object ob-n using, as the sound generation timing of the sound sample, the time at which the x-coordinate value of the object ob-n matches the x-coordinate value of the timing pointer 62.

In the time line task tsk-0*j* corresponding to the time line LINE-0*j*, the CPU 22 monitors the y coordinate value of the timing pointer 62 while periodically repeating an operation for moving the timing pointer 62 from an upper end to a lower end of the time line LINE-0*j* during the period T. When the y-coordinate value of the object ob-n located at the grid point gp-ij of the time line LINE-0*j* matches the y-coordinate value of the timing pointer 62, the CPU 22 determines that the time at which the y-coordinate value of the object ob-n matches the y-coordinate value of the timing pointer 62 is a sound generation timing and performs a process for sound generation of a sound sample corresponding to the object ob-n.

The user may also perform a time line position change operation as needed. Through the time line position change operation in this embodiment, the user may translate a time line LINE-i0 or LINE-0*j* in the time line matrix MTRX to a position at which the time line overlaps one of two adjacent grid lines g located at both sides of the time line. The user may perform a time line position change operation on a time line at which an object ob-n is present at a grid point gp-ij from among the time lines LINE-i0 (i=1~4) and LINE-0*j* (j=1~4) and may also perform a time line position change operation on a time line at which no object ob-n is present at a grid point gp-ij from among the time lines LINE-i0 (i=1~4) and LINE-0*j* (j=1~4). The user may perform a time line position change operation on an inactive time line and may also perform a time line position change operation on an active time line.

Figure 18:
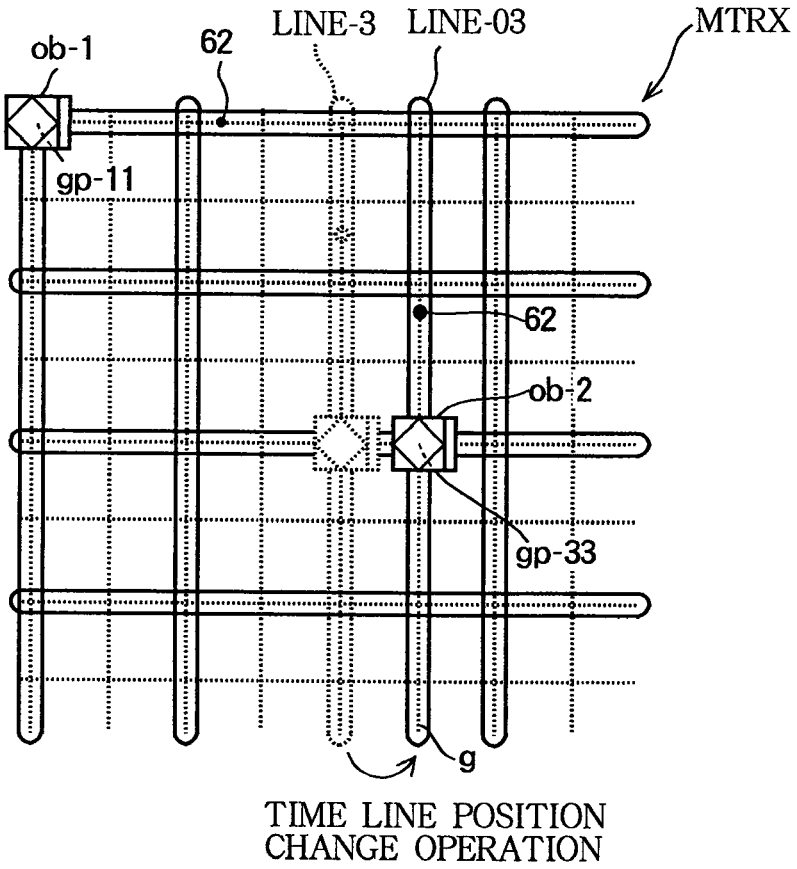
FIG. 18 illustrates an exemplary arrangement of a time line matrix and objects in the display region.

In the object management process 30 in this embodiment, in the case where an object ob-n is present at a grid point gp-ij (a grid point gp-33 of a time line LINE-03 in the example of FIG. 18) of a time line on which the user has performed a time line position change operation, the CPU 22 moves the object ob-n following the movement of the time line on which the user has performed a time line position change operation as shown in FIG. 18. In addition, the CPU 22 rewrites object management information in the RAM 23, which is associated with the object ob-n on the grid point gp-ij of the time line on which the user has performed a time line position change operation, with information representing horizontal and vertical positions of the moved object ob-n.

Various compositions performed using a time line matrix MTRX and an object ob-n and various modes of automatic performance of the compositions in this embodiment are described below with reference to specific examples.

Figure 19:
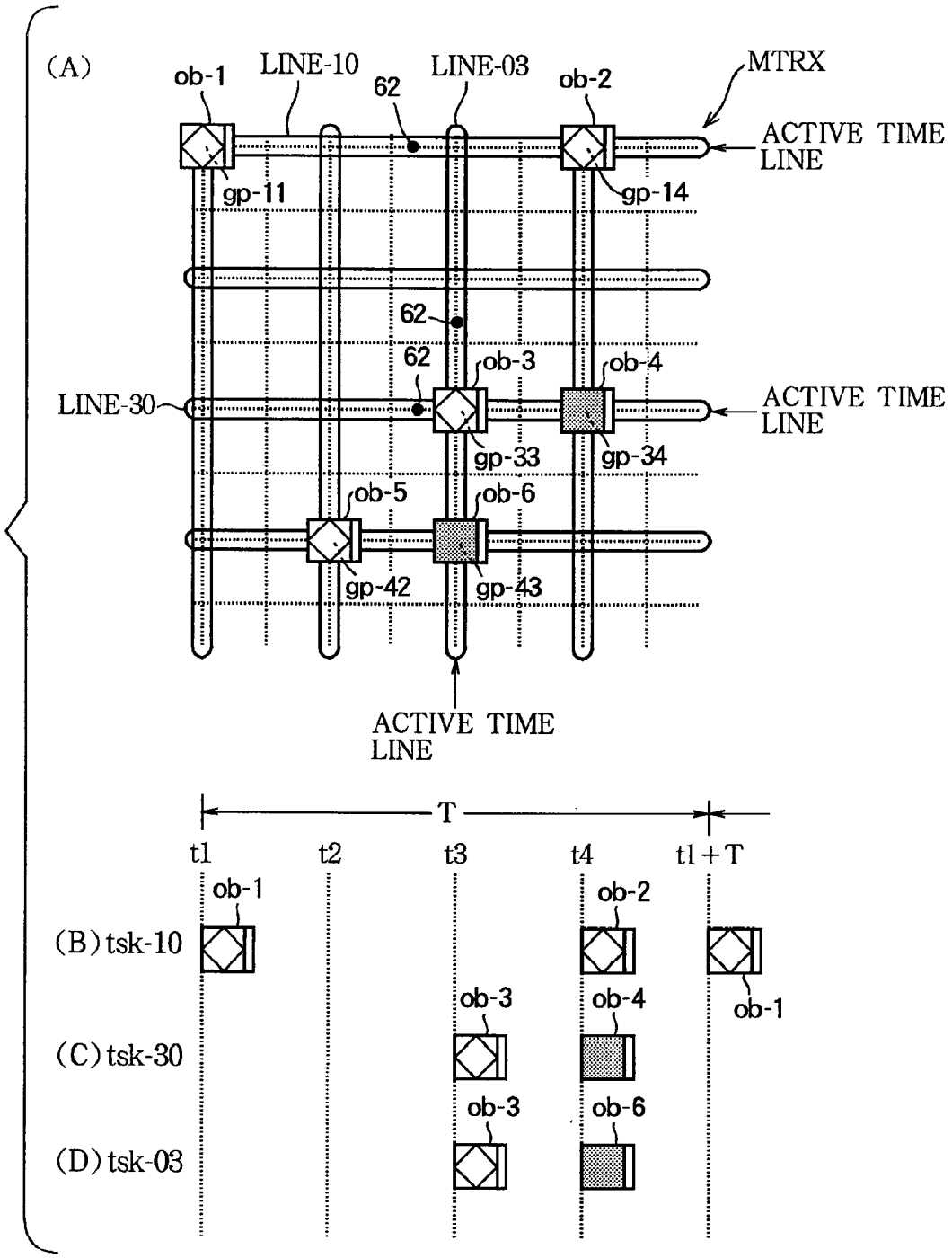
FIG. 19 illustrates an exemplary arrangement of a time line matrix and objects in the display region and the contents of a piece of music created through the arrangement.

In an example of FIG. 19(A), an object ob-1 is present at a grid point gp-11 of a time line matrix MTRX, an object ob-2 is present at a grid point gp-14, and an object ob-3 is present at a grid point gp-33. In addition, an object ob-4 is present at a grid point gp-34, an object ob-5 is present at a grid point gp-42, and an object ob-6 is present at a grid point gp-43. In this example, the time lines LINE-10, LINE-30, and LINE-03 are active time lines.

In this example, the CPU 22 launches time line tasks tsk-10, tsk-30, and tsk-03 corresponding to time lines LINE-10, LINE-30, and LINE-03 and performs the three time line tasks tsk-10, tsk-30, and tsk-03 in parallel to each other and independently of each other. In the time line task tsk-10, the CPU 22 performs sound generation of a sound sample of the object ob-1 at a time t1 from among times t1, t2, t3, and t4 at which the period T is divided into four equal parts and performs sound generation of a sound sample of the object ob-2 at the time t4 as shown in FIG. 19(B). In the time line task tsk-30, the CPU 22 performs sound generation of a sound sample of the object ob-3 at the time t3 and performs sound generation of a sound sample of the object ob-4 at the time t4 as shown in FIG. 19(C). In the time line task tsk-03, the CPU 22 performs sound generation of a sound sample of the object ob-3 at the time t3 and performs sound generation of a sound sample of the object ob-6 at the time t4 as shown in FIG. 19(D).

Figure 20:
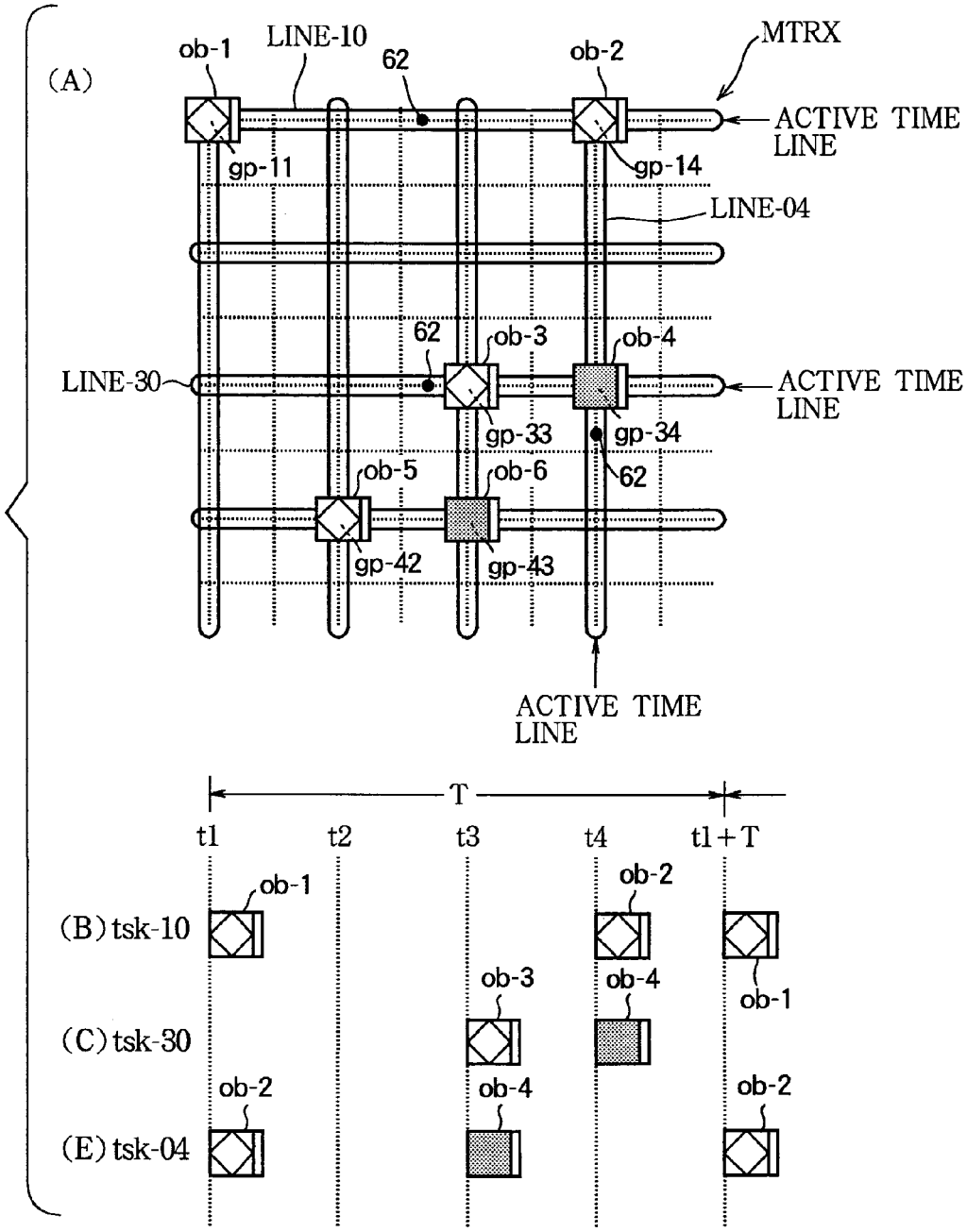
FIG. 20 illustrates an exemplary arrangement of a time line matrix and objects in the display region and the contents of a piece of music created through the arrangement.

An example of FIG. 20(A) is obtained by converting the active time line LINE-03 into an inactive time line and converting the inactive time line LINE-04 into an active time line in the example of FIG. 19(A). In this case, the CPU 22 launches and performs a time line task tsk-04 corresponding to the time line LINE-04 instead of the time line task tsk-03 corresponding to the time line LINE-03. In the time line task tsk-04, the CPU 22 performs sound generation of a sound sample of the object ob-2 at a time t1 from among times t1, t2, t3, and t4 at which the period T is divided into four equal parts and performs sound generation of a sound sample of the object ob-4 at the time t3 as shown in FIG. 20(E).

Figure 21:
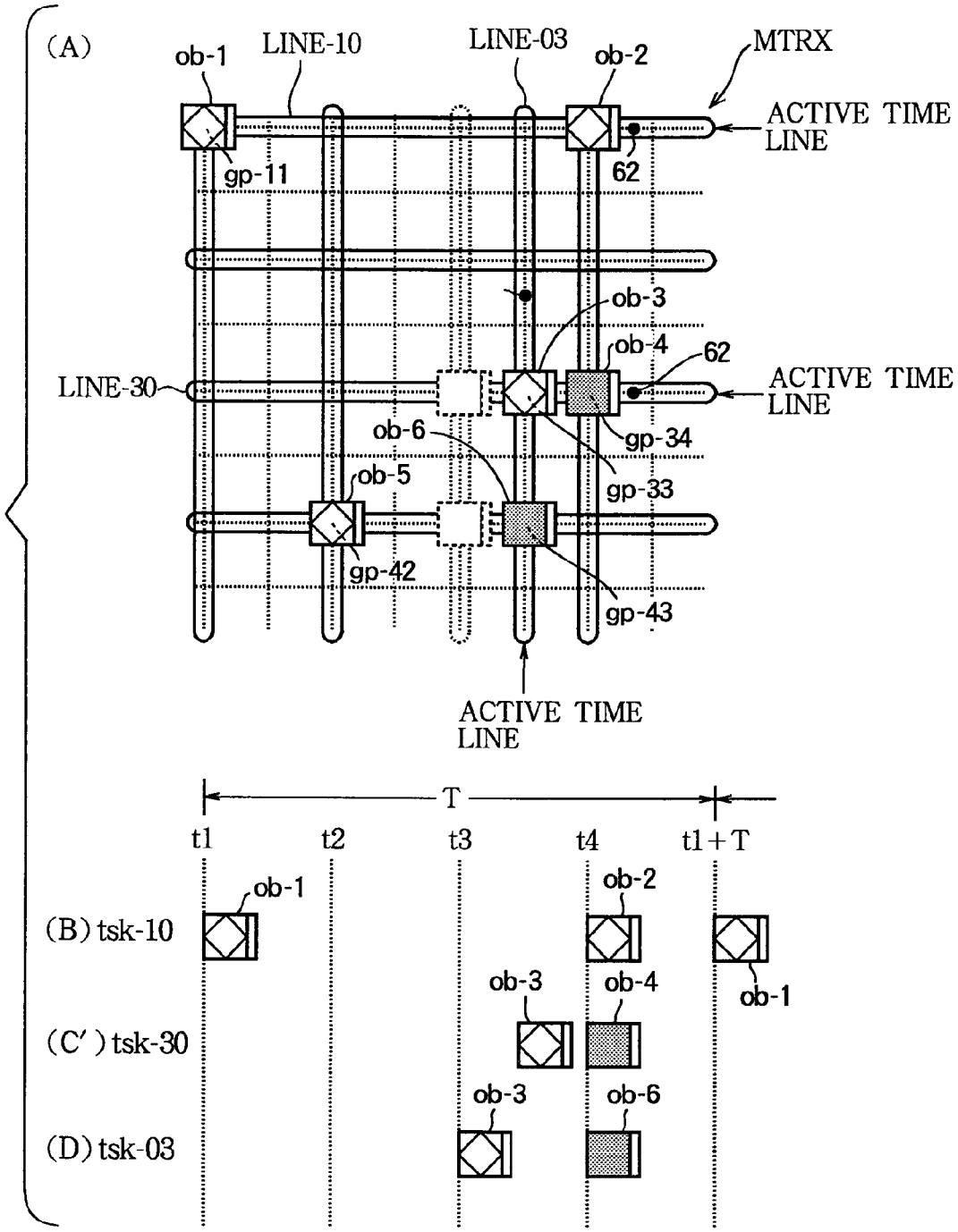
FIG. 21 illustrates an exemplary arrangement of a time line matrix and objects in the display region and the contents of a piece of music created through the arrangement.

An example of FIG. 21(A) is obtained by moving the active time line LINE-03 in the example of FIG. 19(A) in the x-axis direction to a position at which the time line LINE-03 overlaps the left grid line g. In the case where the time line LINE-03 has been moved in the x-axis direction as in this example, the objects ob-3 and ob-4 at the grid points gp-33 and gp-43 of the time line LINE-03 move to the right grid line g following the time line LINE-03. The time line LINE-30 among the two remaining active time lines shares the object ob-3 with the time line LINE-03. Accordingly, after the time line LINE-03 is moved to the right grid line g, the CPU 22 performs, in a time line task tsk-30 corresponding to the time line LINE-30, sound generation of the sound sample, which is performed at the time t3 until the time line LINE-03 is moved, at a time (t3+t4)/2 as shown in FIG. 21(C').

The sound search/musical performance program 29 in this embodiment displays the time line matrix MTRX in the display region of the display unit 17 as described above. In the automatic performance process 34, the CPU 22 determines that the assignment relationship of an object ob-n located at a grid point gp-ij in the time line matrix MTRX with two time lines, which intersect at the grid point gp-ij, is such that the time lines share the object ob-n located at the grid point gp-ij. The CPU 22 determines a sound sample included in a phrase corresponding to each active time line and a sound generation timing of the sound sample based on the assignment relationship. Accordingly, the user can create a piece of music including phrases of a plurality of periods which overlap on the time axis through a simple operation such as an operation for placing an object ob-n on a desired grid point gp-ij in the time line matrix MTRX to select a time line to be activated.

Similar to the first embodiment, in this embodiment, when a layout storage operation has been performed, the CPU 22 determines, in the composition information management process 32, that information such as positions of time lines LINE-i0 and LINE-0*j* in the display region and positions (x-coordinate values, y-coordinate values) of objects ob-n located at grid points gp-ij is arrangement information. A set of this arrangement information and the object management information of the objects ob-n is stored as layout information in the hard disk 25. In addition, when a layout read operation has been performed, the CPU 22 reconstructs display content in the display region based on the layout information. Accordingly, the user can continue the sample arrangement task using another computer, on which the sound search/musical performance program 29 has been installed, by copying layout information that is stored in the hard disk 25 through a layout storage operation to a hard disk 25 of the computer.

Although the first and second embodiments of the invention have been described above, other embodiments are also possible according to the invention. The following are examples.

(1) In the first and second embodiments, in the case where an object ob-n in the display region of the display unit 17 has been copied, the CPU 22 may control attributes (such as pitch, volume, the amount of delay of sound generation timing) of sound generation of a sound represented by the copied object ob'-n using common parameters with the sound sample represented by the original object ob-n.

(2) In the first and second embodiments, sound generation is performed on sound samples corresponding to edge and dust sounds from among sound samples included in music data md-k (k=1, 2, . . . ) to generate sounds represented by objects ob-n. However, sound generation may also be performed on a sound sample corresponding to the overall unit of any sound, which can be classified or identified from features of the sounds, other than edge and dust sounds.

(3) In the first embodiment, an object ob-n belonging to each time line LINE-i is determined based on the positional relationship of the object ob-n and the time line LINE-i. However, the method for determining the assignment relationship between the time line LINE-i and the object ob-n is not limited to this method. For example, objects ob-n belonging to each time line LINE-i may be determined by performing an operation for designating one or a plurality of objects ob-n to be assigned to the time line LINE-i, one by one or by performing an operation for drawing a curve surrounding one or a plurality of objects ob-n to be assigned to the time line LINE-i, by operating a pointing device such as the mouse 14 with the time line LINE-i and the objects ob-n being displayed.

(4) In the first and second embodiments, the shapes of the objects ob-n may be a circle, a polygon, or an arbitrary form. In this case, the search conditions SC-n may be changed according to change of the shapes of the objects ob-n. For example, when an object ob-n is pentagonal, 5 types of search conditions SC-n such as feature quantities P and the requested number of searches Num may be individually controlled according to the distances of 5 vertices of the pentagon from the center thereof.

(5) While the density (or darkness) of display color of each object ob-n is changed through a search condition specifying operation in the first and second embodiments, the hue of the display color may also be changed through the same operation.

(6) In the first and second embodiments, the CPU 22 may also set the number of measures and a meter of each of phrases represented by time lines LINE-i (i=1, 2 . . . ) displayed in the display region of the display unit 17 according to an operation of the operating unit 13. In addition, in the first embodiment, the CPU 22 may increase or decrease the number of beat guide lines 63-*j* (j=1, 2 . . . ) of the time line LINE-i in association with the meter of the phrase represented by the time line LINE-i.

(7) In the first and second embodiments, the CPU 22 may also set a parameter (for example, Beats Per Minute (BPM)) which determines the tempo of each of the phrases represented by the time lines LINE-i, LINE-i0, and LINE-0*j* according to an operation of the operating unit 13. The CPU 22 may also set a parameter (for example, time base (resolution)) which determines the length of time of one beat of each of the phrases represented by the time lines LINE-i, LINE-i0, and LINE-0*j* according to an operation of the operating unit 13.

(8) In the first embodiment, the CPU 22 performs, in a time line task tsk-i corresponding to one time line LINE-i, sound generation of a sound sample corresponding to an object ob-n present in the occupied region of the time line LINE-i when the x-coordinate value of the left upper corner of the object ob-n matches the x coordinate value of the timing pointer 62. However, the CPU 22 may also perform sound generation of the sound sample corresponding to the object ob-n when the x-coordinate value of a different position of the object ob-n such as the center, the left lower corner, the right upper corner, or a right lower corner thereof matches the x-coordinate value of the timing pointer 62.

(9) In the first embodiment, the CPU 22 develops an object ob-n at an arbitrary position in a time line LINE-i specified through an object development operation regardless of the number of beat guide lines 63-*j* (j=1, 2 . . . ) in the time line LINE-i. However, the CPU 22 may also perform quantization control to correct the position of the object ob-n developed in the time line LINE-i such that the x-coordinate value of the object ob-n (for example, the x-coordinate value of the left upper corner of the object ob-n) matches the x-coordinate value of a nearest beat guide line 63-*j*.

(10) In the first and second embodiments, each time line LINE-i is a straight line image that extends in a horizontal or vertical direction. However, the time line LINE-i may also be a curve (including a closed curve).

(11) In the first embodiment, the area of the occupied region of each time line LINE-i may be allowed to be increased through an operation for extending the length of a beat guide line 63-*j* (j=1~5) of the time line LINE-i in a y-axis direction.

(12) In the first and second embodiments, the timing pointer 62 of each of the time lines LINE-i, LINE-i0, and LINE-0*j* does not need to move at a constant speed along a track from the left end to the right end of the time line LINE-i or LINE-i0 or along a track from the upper end to the lower end of the time line LINE-0*j*. For example, the timing pointer 62 may move while a specific section on a track from the left end to the right end of the time line LINE-i or LINE-i0 appears to be widened or narrowed or while a specific section on a track from the upper end to the lower end of the time line LINE-0*j* appears to be widened or narrowed.

(13) In the sound processing process 36 in the first embodiment, the CPU 22 changes parameters such as pitch, volume, and the amount of delay of the sound generation timing. However, in the sound processing process 36, the CPU 22 may perform a reverb process or an equalization process and may change parameters which determine the results of these processes according to a distance $d_y$ from the time line LINE-i to the object ob-n.

(14) In the first embodiment, when the parameter linkage mode has been set, the CPU 22 changes the pitch, the volume, and the amount of delay of the sound generation timing of the sound sample corresponding to the object ob-n according to the distance $d_y$ from the time line LINE-i to the object ob-n. However, the CPU 22 may perform control to select a sound sample which has a lower pitch from among a plurality of sound samples included in the search result SR-n corresponding to the object ob-n as the distance $d_y$ from the time line LINE-i to the object ob-n increases and to select a sound sample which has a higher pitch from among the plurality of sound samples included in the search result SR-n corresponding to the object ob-n as the distance $d_y$ from the time line LINE-i to the object ob-n decreases.

(15) In the operation log management process 37 in the first and second embodiments, each time sound generation is performed for a sound sample associated with an object ob-n in the display region according to a manual performance operation, the CPU 22 may convert a pair of the sound sample and a sound generation time of the sound sample into sequence data and then may include the sequence data in the object management information of the object ob-n.

(16) In the first and second embodiments, the CPU 22 may convert each phrase, which is generated according to a positional relationship between the time lines LINE-i, LINE-i0, and LINE-0*j* displayed in the display region of the display unit 17 and one or a plurality of objects ob-n belonging to the time lines LINE-i, LINE-i0, and LINE-0*j*, into sequence data and then may associate the sequence data with a new object ob-n (for example, an object ob-10). Then, in the case where the object ob-10 is assigned to another time line (for example, a time line LINE-6), the CPU 22 may reproduce the sequence data that is associated with the object ob-10 at a sound generation timing determined according to a positional relationship between the object ob-10 and the time line LINE-6.

(17) In the first embodiment, the CPU 22 may perform control to increase the speed of movement of the timing pointer 62 as the position of the time line LINE-i in the display region of the display unit 17 is higher and may perform control to decrease the speed of movement of the timing pointer 62 as the position of the time line LINE-i in the display region of the display unit 17 is lower. In addition, the CPU 22 may move the object ob-n displayed in the display region of the display unit 17 downward so as to appear to be falling and may control the speed of the movement of the object ob-n according to setting of a parameter defining gravity or the like.

(18) In the first and second embodiments, each object ob-n is an image representing the search result SR-n of the sound sample and, in one time line task tsk-i, tsk-i0, or tsk-0*j* corresponding to one time line LINE-i, LINE-i0, or LINE-0*j*, the CPU 22 selects one of a plurality of sound samples included in a search result SR-n corresponding to a search result SR-n of an object ob-n belonging to the time line LINE-i, LINE-i0, or LINE-0*j* when the x-coordinate value or y-coordinate value of the object ob-n matches the x-coordinate value or y-coordinate value of the timing pointer 62 and performs sound generation of the selected sound sample through the sound system 91. However, each object ob-n may also be an image representing one or a plurality of sound samples for sound generation. In this mode, each of the objects ob-n (n=1, 2 . . . ) is previously associated with one or a plurality of sound samples. Then, in one time line task tsk-7 corresponding to one time line LINE-i, LINE-i0, or LINE-0*j* (for example, a time line LINE-7), the CPU 22 performs sound generation of the sound samples associated with the object ob-n belonging to the time line LINE-7 through the sound system 91 when the x-coordinate value of the object ob-n belonging to the time line LINE-7 matches the x-coordinate value of the timing pointer 62.

(19) In the first and second embodiments, the invention is applied to an application program similar to a loop sequencer. However, the invention may also be applied to a sequencer other than the loop sequencer. For example, a plurality of time lines LINE-i (i=1, 2 . . . ), which have different tempos or meters and each correspond to the performance time of one piece of music, may be displayed in the display region of the display unit 17 and the positions of the time lines LINE-i (i=1, 2 . . . ) may be set such that the time lines LINE-i (i=1, 2 . . . ) share one or a plurality of objects ob-n. In addition, a time line LINE-1 corresponding to the performance time of one piece of music and a time line LINE-2 corresponding to a period T of a phrase which is repeated within the performance time of one piece of music may be displayed in the display region of the display unit 17 and the positions of the time lines LINE-1 and LINE-2 may be set such that the time lines LINE-1 and LINE-2 share one or a plurality of objects ob-n.

(20) In the first and second embodiments, even when one object ob-n is assigned to two or more time lines, sound samples represented by the objects ob-n are searched for in the same database (which is the sound sample database 27 when the object ob-n is an object of an edge sound and is the sound sample database 28 when the object ob-n is an object of a dust sound). However, in the case where a plurality of databases is provided for each sound sample type (for example, each of the edge and dust sounds) and one object ob-n is assigned to two or more time lines, the database in which a corresponding sound sample is searched for may be different for each of the time lines to which the object ob-n is assigned.

For example, this embodiment is realized in the following manner. First, a sound sample database 27A in which sound samples of edge sounds which sound hard from among the edge sounds included in the music data md-k are stored in association with feature quantities $P_{LOW}$, $P_{MID\text{-}LOW}$, $P_{MID\text{-}HIGH}$, $P_{HIGH}$, $P_{TIME}$, and $P_{VALUE}$, a sound sample database 27B in which sound samples of edge sounds which sound soft from among the edge sounds included in the music data md-k are stored in association with feature quantities $P_{LOW}$, $P_{MID\text{-}LOW}$, $P_{MID\text{-}HIGH}$, $P_{HIGH}$, $P_{TIME}$, and $P_{VALUE}$, a sound sample database 28A in which sound samples of dust sounds which sound hard from among the dust sounds included in the music data md-k are stored in association with feature quantities $P_{LOW}$, $P_{MID\text{-}LOW}$, $P_{MID\text{-}HIGH}$, $P_{HIGH}$, $P_{TIME}$, and $P_{VALUE}$, and a sound sample database 28B in which sound samples of dust sounds which sound soft from among the dust sounds included in the music data md-k are stored in association with feature quantities $P_{LOW}$, $P_{MID\text{-}LOW}$, $P_{MID\text{-}HIGH}$, $P_{HIGH}$, $P_{TIME}$, and $P_{VALUE}$ are provided in the hard disk 25.

In addition, the CPU 22 displays a time line matrix MTRX and objects ob-n in the display region of the display unit 17 according to an operation of the operating unit 13, similar to the procedure of the second embodiment. The CPU 22 then launches and performs time line tasks tsk-i0 and tsk-0*j* corresponding to active time lines from among time lines LINE-i0 (i=1~4) and LINE-0*j* (j=1~4) of the time line matrix MTRX. Then, in the time line task tsk-i0, the CPU 22 searches for a sound sample of an edge sound (or a dust sound) represented by an object ob-n located at a grid point gp-ij of the time line LINE-i0 in the sound sample database 27A (or 28A) and performs sound generation of the found sound sample. In the time line task tsk-0*j*, the CPU 22 searches for a sound sample of an edge sound (or a dust sound) represented by an object ob-n located at a grid point gp-ij of the time line LINE-0*j* in the sound sample database 27B (or 28B) and performs sound generation of the found sound sample.

According to this configuration, the CPU 22 generates a sound which feels hard each time a timing pointer 62 which moves in a horizontal direction along the time line LINE-i0 overlaps the object ob-n located at the grid point gp-ij of the time line LINE-i0 and generates a sound which feels soft each time a timing pointer 62 which moves in a horizontal direction along the time line LINE-0*j* overlaps the object ob-n located at the grid point gp-ij of the time line LINE-0*j*. Accordingly, it is possible to create a piece of music which is more creative.

(21) In the second embodiment, the CPU 22 may define a track, which can pass through a plurality of grid points gp-ij from among grid points gp-ij (i=1~4, j=1~4) in the time line matrix MTRX, as a time line LINE" and may repeat control to perform sound generation of each sound represented by each object ob-n on the grid points gp-ij at a sound generation timing that is determined based on a position of the object ob-n in the longitudinal direction of an extended version of the time line LINE".

Figure 22:
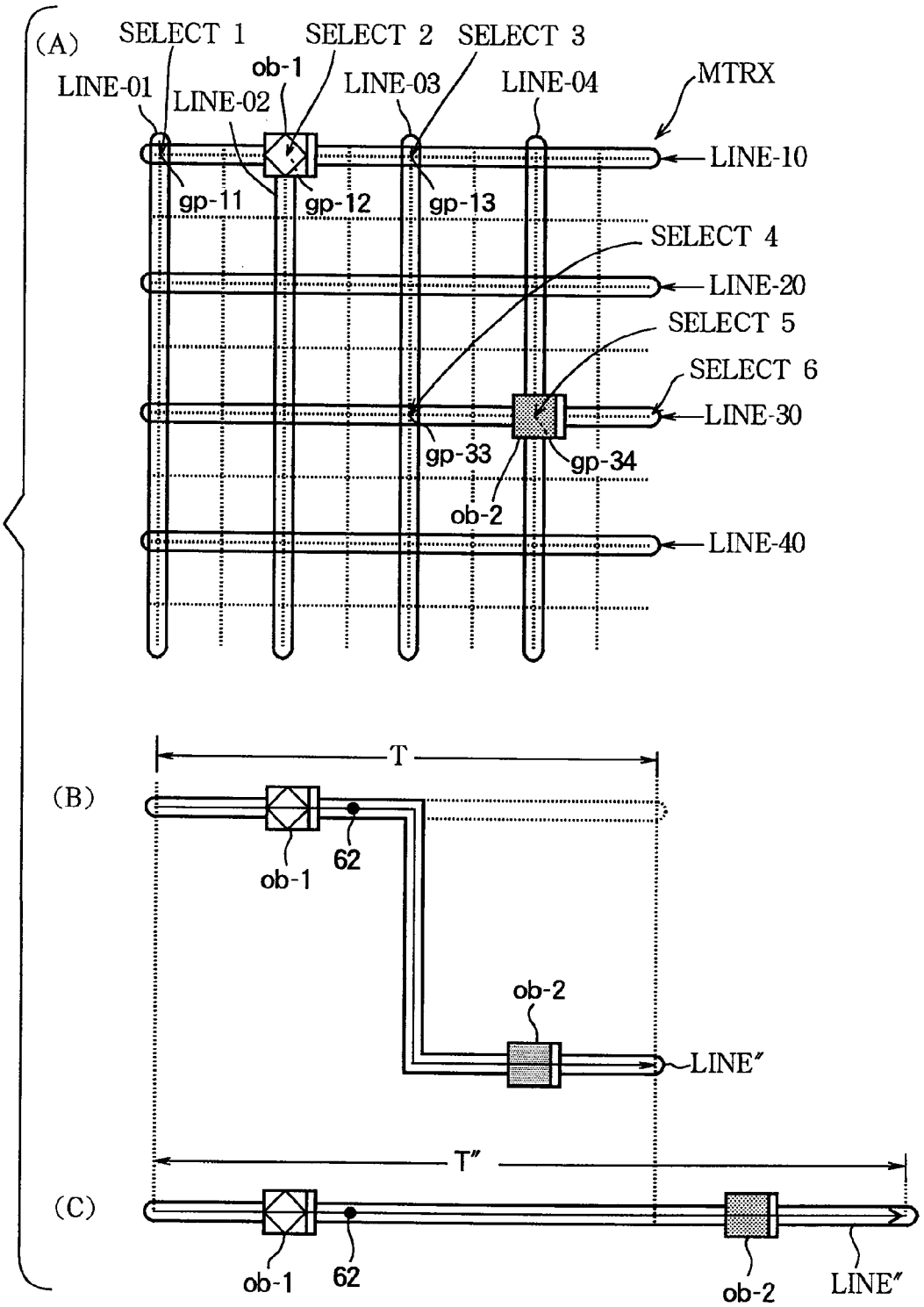
FIG. 22 illustrates a time line matrix displayed in a display region of a sound search/musical performance apparatus which is another embodiment of the invention and time lines formed in the matrix.

For example, this embodiment is realized in the following manner. The user performs a grid point selection operation after performing an operation for arranging objects ob-n at grid points gp-ij in the time line matrix MTRX. As shown in FIG. 22(A), through the grid point selection operation, the user sequentially selects a plurality of grid points gp-ij (grid points gp-11, gp-12, gp-13, gp-33, and gp-34 in an example of FIG. 22(A)) including grid points at which the objects ob-n are arranged. Through the selection operation, the user also selects one end of one of two time lines LINE-i0 and LINE-0*j* which intersect at the finally selected grid point gp-ij (a right end of the time line LINE-30 in an example of FIG. 22(A)).

In the automatic performance process 34, when the grid point selection operation has been performed, the CPU 22 defines a track, which can pass through the grid points gp-ij selected through the grid point selection operation and the end of the time line LINE-i0 or LINE-0*j*, as a time line LINE". The CPU 22 then obtains a time length T" by substituting the number of time lines LINE-i0 "NI" (NI=2 in the example of FIG. 22(A)) and the number of time lines LINE-0*j* "NJ" (NJ=4 in the example of FIG. 22(A)) present between the grid point gp-ij initially selected through the grid point selection operation and the end of the time line LINE-i0 or LINE-0*j* selected through the same operation into the following equation. The CPU 22 determines that the obtained time length T" is a period T" corresponding to the time line LINE".

$$T''=(NI+NJ)\times T/4 \quad (1)$$

The CPU 22 then launches and performs a time line task tsk" corresponding to the time line LINE". FIGS. 22(B) and 22(C) illustrate a time line LINE" and an extended version of the time line LINE", respectively. As shown in FIGS. 22(B) and 22(C), in the time line task tsk" corresponding to the time line LINE", the CPU 22 monitors the x-coordinate value and the y-coordinate value of the timing pointer 62 while repeating an operation for moving the timing pointer 62 from the beginning to end of the time line LINE" during the period T". The CPU 22 then performs a process for generating a sound of a sound sample corresponding to an object ob-n located at a grid point gp-ij of the time line LINE" when the x-coordinate value and the y-coordinate value of the object ob-n match the x-coordinate value and the y-coordinate value of the timing pointer 62.

(22) In the second embodiment, an image including the time lines LINE-i0 (i=1~4) and the time lines LINE-i0 (i=1~4) which intersect at right angles is defined as the time line matrix MTRX. However, an image including the time lines LINE-i0 (i=1~4) and the time lines LINE-i0 (i=1~4) which intersect at angles less than or greater than 90 degrees may also be defined as the time line matrix MTRX.

(23) In the second embodiment, the number of time lines LINE-i0 "M" included in the time line matrix MTRX may be 2 or 3 and may also be 5 or more. In addition, the number of time lines LINE-0*j* "N" included in the time line matrix MTRX may be 2 or 3 and may also be 5 or more. The number of time lines LINE-i0 "M" included in the time line matrix MTRX may be different from the number of time lines LINE-0*j* "N" included in the time line matrix MTRX. All of the plurality of time lines LINE of the time line matrix MTRX do not need to intersect other time lines LINE to form grid points gp. At least two of the plurality of time lines LINE of the time line matrix MTRX may intersect each other to form one grid point gp.

(24) In the second embodiment, the time line matrix MTRX is a 2-dimensional matrix in which time lines LINE-i0 (i=1~4) arranged in a vertical direction and time lines LINE-0*j* (j=1~4) arranged in a horizontal direction intersect. However, the time line matrix MTRX is a 3-dimensional matrix in which a plurality of time lines LINE arranged in a vertical direction, a plurality of time lines LINE arranged in a horizontal direction, and a plurality of time lines LINE arranged in a direction (i.e., depthwise direction) perpendicular to both the horizontal and vertical directions intersect.

(25) In the second embodiment, 3 or more grid lines g may also be provided at equal intervals between adjacent time lines LINE-i0 and between adjacent time lines LINE-0*j* in the time line matrix MTRX. The user may be allowed to set the number of grid lines g between adjacent time lines LINE-i0 and the number of grid lines g between adjacent time lines LINE-0*j* through operation of the operating unit 13.

(26) In the first embodiment, all time lines LINE-i displayed in the display region of the display unit 17 are linear images extending in the same direction (x-axis direction). However, the CPU 22 may display time lines LINE-i, which are line images extending in a first direction (for example, in the x-axis direction), and time lines LINE-i, which are line images extending in a second direction (for example, in the y-axis direction), in the display region of the display unit 17 and may allow the user to freely change a positional relationship of the two types of time lines LINE-i in the display region. Then, in the case where a time line LINE-i (for example, a time line LINE-8) extending in the first direction and a time line LINE-i (for example, a time line LINE-9) extending in the second direction in the display region of the display unit 17 intersect and an object ob-n is present at a grid point at which the two time lines LINE-8 and LINE-9 intersect, in the automatic performance process 34, the CPU 22 may determine that the assignment relationship of the time lines LINE-8 and LINE-9 is such that the time lines LINE-8 and LINE-9 which intersect at the grid point share the object ob-n present at the grid point.

(27) In the first and second embodiments, a variety of feature quantities other than the low band intensity $P_{LOW}$, the middle low band intensity $P_{MID\text{-}LOW}$, the middle high band intensity $P_{MID\text{-}HIGH}$, the high band intensity $P_{HIGH}$, the peak position $P_{TIME}$, and the peak intensity $P_{VALUE}$ may also be stored in the sound sample databases 27 and 28 in association with the times $t_S$, $t_E$ of the start and end points of each sound sample.

(28) In the first and second embodiments, the sound sample database 27 for edge sounds and the sound sample database 28 for dust sounds may be combined into one sound sample database for storing sound materials used for composing a piece of music.

(29) In the automatic performance process 34 in the second embodiment, an object ob-n present at a grid point gp-ij of the time line matrix MTRX may be defined as belonging to both two time lines LINE-i0 and LINE-0*j* that intersect at the grid point gp-ij and an object ob-n present at a position, deviating from the grid point gp-ij, on the time line LINE-i0 (or the time line LINE-0*j*) may be defined as belonging only to the time line LINE-i0 (or the time line LINE-0*j*). In this case, not only an object ob-n which completely overlaps the time line LINE-i0 (or the time line LINE-0*j*) but also an object ob-n which is present above or below the time line LINE-i0 (or at the left or right side of the time line LINE-0*j*) within a predetermined range from the time line LINE-i0 (or the time line LINE-0*j*) may also be defined as belonging to the time line LINE-i0 (or the time line LINE-0*j*).

What is claimed is:

1. A musical performance apparatus comprising:

a processor configured to:

display a plurality of time lines on a display along a time axis according to an operation, each time line being an image representing a period of a phrase and being independently adjustable in position, length or period thereof according to an operation;

allocate a plurality of objects to at least one of the plurality of time lines on the display according to an operation, each object being a symbol corresponding to and representing a sound to be generated, a first object of the plurality of objects being allocated as a common object belonging to at least two of the plurality of time lines on the display, wherein one or more objects allocated to a time line forms a phrase; and generate, independently for each time line and repeatedly at a period corresponding to each time line, sound corresponding to the one or more objects allocated to a time line at a timing determined according to a position of each of the one or more objects in a longitudinal direction of the time line so as to repeat sound generation of a plurality of phrases corresponding to the plurality of time lines along the time axis, wherein at least a portion of at least one of the plurality of phrases is overlapped with one or more of the others of the plurality of phrases in the time axis.

2. The musical performance apparatus according to claim 1, wherein the plurality of objects are allocated to the at least one of the time lines based on a positional relationship between the plurality of objects and the at least one of the plurality of time lines on the display.

3. The musical performance apparatus according to claim 2, wherein the processor is configured to control a parameter representing a sound generation mode of the sounds represented by the plurality of objects according to a distance from each of the plurality of objects to the at least one of the plurality of time lines to which the plurality of objects are allocated.

4. A musical performance apparatus comprising:

an operating part;

a display part;

a time line management processing part that displays a plurality of time lines on the display part according to an operation of the operating part, each time line being an image representing a period of phrase that repeats in a piece of music, the time line management processing part displaying the time lines on the display part such as to intersect with each other;

an object management processing part that displays at least one object on the display part according to an operation of the operating part, a first object of the at least one object being a symbol corresponding to and representing a sound to be generated, the object management processing part displaying the first object at a grid point at which the time lines intersect with each other; and a musical performance processing part that determines belongingness of the first object to the time lines displayed on the display part such that the first object belongs to both of the time lines intersecting with each other at the grid point where the first object is placed, and that repeats control of generating a sound corresponding to the first object in parallel and independently for each time line at the period corresponding to each time line such that the sound is generated at a sound generation timing determined according to a position of the first object in a longitudinal direction of each time line to which the first object belongs.

5. The musical performance apparatus according to claim 1, wherein the processor is configured to:

store materials representing a plurality of sounds and feature quantity data in correspondence to the plurality of the sounds, the feature quantity data representing a plurality of features of the plurality of sounds;

display an object having a form indicating a search condition for searching a sound having desired features;

changes the form of the object and the searching condition of the desired sound in association with each other according to an operation; and searches the stored feature quantity data based on the searching condition to locate at least one sound having features which meet the search condition.

6. The musical performance apparatus according to claim 5, wherein the processor is configured to:

display the object having the form indicating, as the searching condition, features of desired sounds and a requested number of the desired sounds to be located;

search the stored feature quantity data based on the searching condition to locate the requested number of sounds having features which meet the search condition.

7. The musical performance apparatus according to claim 5, wherein the processor is configured to:

display a new object on the display according to an operation, the new object being copied from an original object displayed on the display such that the new object has the same form as that of the original object; and update one of the searching condition indicated by the form of the new object and the searching condition indicated by the form of the original object when the other of the searching condition indicated by the form of the new object and the searching condition indicated by the form of the original object has been updated.

8. A machine readable medium for use in a computer, the medium containing program instructions executable by the computer to:

display a plurality of time lines on a display along a time axis according to an operation, each time line being an image representing a period of a phrase and being independently adjustable in position, length or period thereof according to an operation;

allocate a plurality of objects to at least one of the plurality of time lines on the display according to an operation, each object being a symbol corresponding to and representing a sound to be generated, a first object of the plurality of objects being allocated as a common object belonging to at least two of the plurality of time lines on the display, wherein one or more objects allocated to a time line forms a phrase; and generate, independently for each time line and repeatedly at a period corresponding to each time line, sound corresponding to the one or more objects allocated to a time line at a timing determined according to a position of each of the one or more objects in a longitudinal direction of the time line so as to repeat sound generation of a plurality of phrases corresponding to the plurality of time lines along the time axis, wherein at least a portion of at least one of the plurality of phrases is overlapped with one or more of the others of the plurality of phrases in the time axis.

9. The machine readable medium according to claim 8, containing the program instructions executable by the computer to:

store materials representing a plurality of sounds and feature quantity data in correspondence to the plurality of the sounds, the feature quantity data representing a plurality of features of the plurality of sounds;

display an object having a form indicating a search condition for searching a sound having desired features;

change the form of the one object and the searching condition of the desired sound in association with each other according to an operation; and search the feature quantity data based on the searching condition to locate at least one sound having features which meet the search condition.

* * * * *